US005916718A

United States Patent [19]

Kellie et al.

[11] Patent Number: 5,916,718

[45] Date of Patent: Jun. 29, 1999

[54] METHOD AND APPARATUS FOR PRODUCING A MULTI-COLORED IMAGE IN AN ELECTROPHOTOGRAPHIC SYSTEM

[75] Inventors: Truman F. Kellie, Lakeland, Minn.; James A. Baker, Hudson, Wis.

[73] Assignee: Imation Corp., Oakdale, Minn.

[21] Appl. No.: 08/948,437

[22] Filed: Oct. 10, 1997

Related U.S. Application Data

[63] Continuation of application No. 08/537,296, Sep. 29, 1995, abandoned.

[51] Int. Cl.[6] ..... G03G 13/00

[52] U.S. Cl. ..... 430/45; 430/54; 430/117; 399/51; 399/57; 399/178

[58] Field of Search ..... 430/45, 54, 117; 399/51, 57, 178

[56] References Cited

U.S. PATENT DOCUMENTS

| | | | |
|---|---|---|---|
| 3,376,133 | 4/1968 | Roteman | 96/1.2 |
| 3,411,936 | 11/1968 | Roteman | 117/37 |
| 3,554,836 | 1/1971 | Steindorf | 156/240 |
| 3,766,072 | 10/1973 | Metcalfe et al. | 252/62.1 |
| 3,832,170 | 8/1974 | Nagamatsu et al. | 96/1.2 |
| 4,017,891 | 4/1977 | Helmberger et al. | 358/6 |
| 4,033,688 | 7/1977 | Orthmann | 355/4 |
| 4,312,932 | 1/1982 | Hauser et al. | 430/41 |
| 4,403,848 | 9/1983 | Snelling | 355/4 |
| 4,578,331 | 3/1986 | Ikeda et al. | 430/42 |
| 4,728,983 | 3/1988 | Zwadlo et al. | 355/4 |
| 4,877,698 | 10/1989 | Watson et al. | 430/45 |
| 5,014,090 | 5/1991 | Santilli | 355/256 |
| 5,049,949 | 9/1991 | Parker et al. | 355/328 |
| 5,061,583 | 10/1991 | Zwadlo et al. | 430/45 |
| 5,083,163 | 1/1992 | Brown et al. | 355/219 |
| 5,085,967 | 2/1992 | Usui et al. | 430/125 |
| 5,115,277 | 5/1992 | Camis | 355/273 |
| 5,136,334 | 8/1992 | Camis et al. | 355/256 |
| 5,204,722 | 4/1993 | Thompson et al. | 355/279 |
| 5,262,259 | 11/1993 | Chou et al. | 430/47 |

(List continued on next page.)

FOREIGN PATENT DOCUMENTS

| | | | |
|---|---|---|---|
| 0 343 853 | 11/1989 | European Pat. Off. . | |
| 0 467 609 | 1/1992 | European Pat. Off. . | |
| 0 513 820 A2 | 11/1992 | European Pat. Off. | G03G 15/01 |
| 0 549 867 A2 | 7/1993 | European Pat. Off. | G03G 15/16 |
| 0 672 965 A1 | 9/1995 | European Pat. Off. | G03G 15/11 |
| 0 684 527 | 11/1995 | European Pat. Off. . | |
| 6-138712 | 5/1994 | Japan | G03G 9/12 |
| 6-138718 | 5/1994 | Japan | G03G 9/13 |
| 6-149001 | 5/1994 | Japan | G03G 15/01 |
| 60214431 | 5/1994 | Japan | G03G 9/13 |

OTHER PUBLICATIONS

Osmond, D.W.J., et al., "The Theoretical Basis for the Steric Stabilization of Polymer Dispersions Prepared in Organic Media", *Dispersion Polymerization in Organic Media*, pp. 9–43.

Wicks, Jr., Zeno W., "Film Formation", *Federation of Societies for Coatings Technology*, Jun. 1986, pp. 7–19.

*Primary Examiner*—Mark Chapman
*Attorney, Agent, or Firm*—William D. Bauer

[57] ABSTRACT

Apparatus and method in which a multi-color image, such as a standard four color image, is assembled on a medium, such as paper or film. Liquid ink contains conventional "solid" colored toner particles and also contains transparent counter ions. The conventional "solid" colored toner particles in plate to the surface of the photoreceptor while the transparent counter ions plate in the opposite direction, i.e., the transparent counter ions plate to the surface of photoreceptor in areas which are not discharged. Conventional "solid" colored toner particles plate to electrode in areas where the photoreceptor has not been discharged while transparent counter ions plate to electrode in areas discharged. This allows an apparatus and method in which the multi-color image can be assembled during a single pass of a photoreceptor without the necessity to erase and externally recharge the photoreceptor between development steps for each separate color resulting in an apparatus and method which can print multiple color images at an unrivaled speed.

54 Claims, 5 Drawing Sheets

U.S. PATENT DOCUMENTS

| | | | |
|---|---|---|---|
| 5,276,492 | 1/1994 | Landa et al. | 355/277 |
| 5,283,148 | 2/1994 | Rao | 430/114 |
| 5,291,251 | 3/1994 | Storlie et al. | 355/271 |
| 5,300,990 | 4/1994 | Thompson | 355/256 |
| 5,320,923 | 6/1994 | Nguyen | 430/78 |
| 5,397,669 | 3/1995 | Rao | 430/108 |
| 5,420,675 | 5/1995 | Thompson et al. | 355/256 |
| 5,452,074 | 9/1995 | Von Hoene et al. | 355/326 |
| 5,576,815 | 11/1996 | Teschendorf et al. | 355/256 |

METHOD AND APPARATUS FOR PRODUCING A MULTI-COLORED IMAGE IN AN ELECTROPHOTOGRAPHIC SYSTEM

This is a continuation of application Ser. No. 08/537,296 filed Sep. 29, 1995 now abandoned.

TECHNICAL FIELD

The present invention relates generally to electrophotography and, more specifically, to methods and apparatus for producing a multi-colored image on a medium in an electrophotographic system.

BACKGROUND OF THE INVENTION

In conventional electrophotography systems, a photoreceptor is supported by a mechanical carrier such as a drum or a belt. First, the photoreceptor is erased by exposure to an erase lamp which "bleeds" away any residual charge remaining on the photoreceptor from previous operations. The photoreceptor then is charged to a generally uniform charge, positive or negative, by subjecting the photoreceptor to a suitable charging device such as a corona or a charge roll. The charge distribution on the photoreceptor is then altered by the image-wise application of radiation, e.g., a laser, to the surface of the photoreceptor creating a latent image corresponding to the image-wise application of radiation on the photoreceptor. Toner is attracted to the photoreceptor in a pattern consistent with the charge distribution of the photoreceptor. The toner is then typically transferred, either directly or through an intermediate medium, from the photoreceptor to a receptor material or medium being printed, e.g., paper or film.

Such an electrophotography process enables the production of high quality images on the receptor material, such as film or paper. Apparatus which may utilize electrophotography include conventional laser printers, photocopiers, proofers, etc.

Monochrome printers produce a hard copy output in one toner color only, typically black. If the laser printer is to be used to print a different color, the conventional black toner cartridge is removed and replaced with a toner cartridge containing toner of another color, e.g., red. However, the laser printer still prints only a single color.

On the other hand, color printers use three primary colors, typically cyan, magenta and yellow, and in addition, optionally, black. Several techniques have been developed over the years to adapt electrophotographic techniques to use multiple colors.

U.S. Pat. No. 3,832,170, Nagamatsu et al, Method of and Apparatus for Electronic Color Photography and Photosensitive Member Used for the Same, (Canon) discloses a photosensitive member consisting basically of a supporting base, a photoconductive layer and an insulating layer dyed in a desired color for providing a color filter effect. Such photosensitive members having different color effects are provided for polychromatic reproduction on a single transferable material. Thus, the method disclosed in Nagamatsu et al requires a separate photosensitive member for each primary color plane. Not only is this method costly and bulky but significant color plane registration problems often occur due to the necessity of the transfer of the final image from multiple photosensitive members.

U.S. Pat. No. 4,578,331, Ikeda et al, Color Image Forming Method, (Ricoh) discloses an electrophotographic color image forming process wherein three light beams, each representing image information of one of three primary colors of a color document to be recorded obtained by color separation, are projected against an electrophotographic photosensitive member to form electrostatic latent images which are developed by toner of the three different colors, respectively, and printed by transfer printing, to record a color image. The image information of three colors is simultaneously written to a surface of the photosensitive member as three scanning lines either by successively writing a plurality of sets of three scanning lines each representing image information of one color or by writing image information of different colors of the same set separately in three different zones, so that the scanning lines representing image information of different colors form a repeating series of three stripes of different colors. The electrostatic latent images formed on the scanning lines are excited in positions immediately before developing sections of respective colors and developed by the toners of respective colors to produce toner images of different color which are printed by transfer printing on a transfer printing sheet. Because the method disclosed in Ikeda et al prints dry, opaque toners in separate zones, or scan lines, this system is limited in the resolution that can be provided. This loss of resolution is caused directly by the interleaving of the color planes within the page.

U.S. Pat. No. 4,728,983, Zwadlo et al, Single Beam Full Color Electrophotography, assigned to Minnesota Mining and Manufacturing Company, the assignee of the present invention, discloses a method of making high quality color prints by electrophotography. A single photoconductive drum is used together with means to erase, electrostatically charge, laser-scan expose and toner develop during a single rotation of the photoconductive drum. In successive rotations, different colored images corresponding to color separation images are assembled in register on the drum. This assembled color image is transferred to a receptor sheet in a final rotation of the drum. Because a separate pass, i.e., rotation, is required for each primary color plane, at least four passes (rotations) are needed to obtain the final four color image print. Separate passes for each of the primary color planes significantly restricts the speed which a multiple color electrophotographic printing process can achieve.

U.S. Pat. No. 4,877,698, Watson et al, Electrophotographic Process for Generating Two-Color Images Using Liquid Developer, (Xerox) discloses a process and apparatus for generating two-color images by charging an imaging member in an imaging apparatus, creating on the member a latent image comprising areas of high, intermediate, and low potential, providing an electrode having a potential within about 100 volts of that of the intermediate potential, enabling generation of an electric field and a development zone between the imaging member and the electrode, and developing the latent image by introducing into the development zone a liquid developer composition containing first toner particles of one color and second toner particles of another color, the particles being dispersed in a liquid medium, wherein the second toner particles are attracted to the high potential and the first toner particles are attracted to the low potential. The process and apparatus disclosed in Watson et al achieves a two-color image in a single pass, indeed a single developing step, but is limited to a maximum of two colors. Thus, this system would not be suitable for a standard four color image.

Thus, there is a need for a laser printing apparatus and process which will print multiple color, e.g., four color, images with improved speed, without sacrificing quality and resolution.

SUMMARY OF THE INVENTION

The present invention provides an apparatus and method in which a multi-color image, such as a standard four color image as prepared in Zwadlo '983, is assembled on a medium, such as paper or film, during a single pass of a photoreceptor without the necessity to erase the photoreceptor between development steps for each separate color. This results in an apparatus and process which can print multiple color images at a speed unrivaled by Zwadlo's '983 process and apparatus and other previous processes and apparatus.

In one embodiment, speed is greatly enhanced due to the complete printing of a four color image in just one cycle of the photoreceptor. Further, cost and complexity is reduced due to the elimination of the need for separate erase step between each of the colors of the image. This is achieved without sacrificing image resolution or image quality. At least some of the liquid inks used in the apparatus and method of the present invention are substantially transparent to the radiation emitted at the wavelength of latent image generator and, hence, can overlay each other providing an image resolution which is equal to the resolution quality of each individual color. There is no need to provide separate areas in the image for toners of each individual toner, either on a dot by dot basis or on a scan line basis.

In another embodiment, the present invention also provides an apparatus and method for recharging a photoreceptor following development by liquid ink without the necessity to erase and to expose the photoreceptor to corona charging between color image planes.

In another embodiment, the present invention also provides an electrophotographic system for producing a multi-color image on a medium without the necessity to erase and recharge the photoreceptor between development steps for each color using a liquid ink having pigmented imaging ions and transparent counter-ions.

One embodiment of the present invention provides a method of producing a multi-colored image on a medium from image data in an electrophotographic system. A photoreceptor is movably positioned in order that a given portion of the photoreceptor sequentially advances past a plurality of locations in a single pass. Any previously accumulated charge is erased from the photoreceptor. The photoreceptor is charged to a predetermined charge level. The photoreceptor is first image-wise exposed to radiation modulated in accordance with the image data for one of a plurality of colors in order to partially discharge the photoreceptor to produce an image-wise distribution of charges on the photoreceptor corresponding to the image data for the one of the plurality of colors. A first color liquid toner is applied to the image-wise distribution of charges on the photoreceptor to form a first color image. The photoreceptor is then exposed to radiation modulated in accordance with the image data for another of the plurality of colors in order to partially discharge the photoreceptor to produce an image-wise distribution of charges on the photoreceptor corresponding to the image data for the another of the plurality of colors in registration with the first color image. Such second image-wise exposing of the photoreceptor occurs without erasing the photoreceptor subsequent to the first image-wise exposing of the photoreceptor. A second color liquid toner is applied to the image-wise distribution of charges on the photoreceptor to form a second color image in registration with the first color image. The first and second color images are transferred together from the photoreceptor to the medium to form the multi-colored image.

Another embodiment of the present invention provides a method of producing a multi-colored image on a medium from image data in an electrophotographic system. A photoreceptor is rotated so that the following steps are performed in order. Any previously accumulated charge is erased from the photoreceptor. The photoreceptor is charged to a first predetermined charge level. The photoreceptor is first image-wise exposed to radiation modulated in accordance with the image data for one of a plurality of colors in order to partially discharge the photoreceptor to produce an image-wise distribution of charges on the photoreceptor corresponding to the image data for the one of the plurality of colors. A first color liquid toner is applied to the image-wise distribution of charges on the photoreceptor to develop the photoreceptor and form a first color image, the photoreceptor recharging as a result of this step to a second predetermined charge level, the second predetermined charge level being lower than the first predetermined charge level but being sufficiently high to subsequently repel liquid toner in areas not subsequently further discharged. The photoreceptor is second image-wise exposing, without erasing previously accumulated charge on the photoreceptor subsequent to the first image-wise exposing step, to radiation modulated in accordance with the image data for another of the plurality of colors in order to partially discharge the photoreceptor to produce an image-wise distribution of charges on a surface of the photoreceptor corresponding to the image data for the another of the plurality of colors in registration with the first color image. A second color liquid toner is applied to the image-wise distribution of charges on the photoreceptor to form a second color image in registration with the first color image. The first and second color images are transferred together from the photoreceptor to the medium to form the multi-colored image.

In another embodiment of the present invention, the first image-wise exposing step and first liquid toner application steps are repeated a total of three times corresponding to the first three color image planes of the multi-color image and then the second (now fourth) image-wise step and second (now fourth) toner application step is performed. All four color image planes are then transferred together from the photoreceptor to the medium to form the multi-colored image.

Preferably, the first color liquid toner is a liquid toner principally contains the color of yellow, wherein the second color liquid toner is a liquid toner principally contains the color of magenta, wherein the third color liquid toner is a liquid toner principally contains the color of cyan and wherein the fourth color liquid toner is a liquid toner principally contains the color of black.

In another embodiment, the present invention provides an apparatus for producing a multi-colored image on a medium from image data in an electrophotographic system. Positioning means movably positions a photoreceptor in order that a given portion of the photoreceptor sequentially advances past a plurality of locations in a single pass. Erasing means erases any previously accumulated charge from the photoreceptor. Charging means charges the photoreceptor to a predetermined charge level. First image-wise exposing means exposes the photoreceptor with radiation modulated in accordance with the image data for one of a plurality of colors in order to partially discharge the photoreceptor to produce an image-wise distribution of charges on the photoreceptor corresponding to the image data for the one of the plurality of colors. First application means applies a first color liquid toner to the image-wise distribution of charges on the photoreceptor to form a first color image. A second image-wise exposing means exposes the photoreceptor with radiation modulated in accordance with the image data for another of the plurality of colors in order to partially discharge the photoreceptor to produce an image-wise distribution of charges on the photoreceptor corresponding to the image data for the another of the plurality of colors in registration with the first color image. The second image-wise exposing occurs without either erasing or charging the photoreceptor subsequent to the first image-wise exposing of the photoreceptor. Second application means applies a second color liquid toner to the image-wise distribution of charges on the photoreceptor to form a second color image in registration with the first color image. Transferring means transfers the first color image and the second color image together from the photoreceptor to the medium to form the multi-colored image.

In another embodiment, the present invention provides an apparatus for producing a multi-colored image on a medium from image data in an electrophotographic system. Rotating means moves a photoreceptor sequentially past a number of locations in order. Erasing means erases any previously accumulated charge from the photoreceptor. Charging means charges the photoreceptor to a first predetermined charge level. First image-wise exposing means exposes the photoreceptor with radiation modulated in accordance with the image data for one of a plurality of colors in order to partially discharge the photoreceptor to produce an image-wise distribution of charges on the photoreceptor corresponding to the image data for the one of the plurality of colors. First application means applies a first color liquid toner to the image-wise distribution of charges on the photoreceptor to develop the photoreceptor and form a first color image, the photoreceptor recharging to a second predetermined charge level, the second predetermined charge level being lower than the first predetermined charge level but being sufficiently high to subsequently repel liquid toner in areas not subsequently further discharged. Second image-wise exposing means exposes the photoreceptor, without erasing previously accumulated charge on the photoreceptor subsequent to the first image-wise exposing, with radiation modulated in accordance with the image data for another of the plurality of colors in order to partially discharge the photoreceptor to produce an image-wise distribution of charges on a surface of the photoreceptor corresponding to the image data for the another of the plurality of colors in registration with the first color image. Second application means applies a second color liquid toner to the image-wise distribution of charges on the photoreceptor to form a second color image in registration with the first color image. Transferring means transfers the first color image and the second color image together from the photoreceptor to the medium to form the multi-colored image.

In another embodiment of the present invention, the first image-wise exposing means and first liquid toner application means are repeated a total of three times corresponding to the first three color image planes of the multi-color image and then the second (now fourth) image-wise means and second (now fourth) toner application means are provided.

Preferably, the first color liquid toner is a liquid toner principally contains the color of yellow, wherein the second color liquid toner is a liquid toner principally contains the color of magenta, wherein the third color liquid toner is a liquid toner principally contains the color of cyan and wherein the fourth color liquid toner is a liquid toner principally contains the color of black.

In another embodiment, the present invention provides a method of producing a multi-colored image on a medium from image data in an electrophotographic system. The photoreceptor is charged to a first predetermined charge level. The photoreceptor is first image-wise exposed to radiation modulated in accordance with the image data for one of a plurality of colors in order to partially discharge the photoreceptor to produce an image-wise distribution of charges on the photoreceptor corresponding to the image data for the one of the plurality of colors. A first color liquid toner is applied to the image-wise distribution of charges on the photoreceptor to develop the photoreceptor and form a first color image, the first color liquid toner containing charged particles of the first color and transparent counter ions, the photoreceptor recharging as a result of this step to a second predetermined charge level, the second predetermined charge level being lower than the first predetermined charge level but being sufficiently high to subsequently repel liquid toner in areas not subsequently further discharged. The photoreceptor is second image-wise exposed to radiation modulated in accordance with the image data for another of the plurality of colors in order to partially discharge the photoreceptor to produce an image-wise distribution of charges on a surface of the photoreceptor corresponding to the image data for the another of the plurality of colors in registration with the first color image. A second color liquid is applied to the image-wise distribution of charges on the photoreceptor to form a second color image in registration with the first color image. The first color image and the second color image are then transferred together from the photoreceptor to the medium to form the multi-colored image.

In another embodiment of the present invention, the first image-wise exposing step and first liquid toner application steps are repeated a total of three times corresponding to the first three color image planes of the multi-color image and then the second (now fourth) image-wise step and second (now fourth) toner application step is performed. All four color image planes are then transferred together from the photoreceptor to the medium to form the multi-colored image.

Preferably, first color liquid toner is a liquid toner principally contains the color of yellow, wherein the second color liquid toner is a liquid toner principally contains the color of magenta, wherein the third color liquid toner is a liquid toner principally contains the color of cyan and wherein the fourth color liquid toner is a liquid toner principally contains the color of black.

In another embodiment, the present invention provides an apparatus for producing a multi-colored image on a medium from image data in an electrophotographic system. Charging means charges the photoreceptor to a first predetermined charge level. First image-wise exposing means exposes the photoreceptor with radiation modulated in accordance with the image data for one of a plurality of colors in order to partially discharge the photoreceptor to produce an image-wise distribution of charges on the photoreceptor corresponding to the image data for the one of the plurality of colors. First application means applies a first color liquid toner to the image-wise distribution of charges on the photoreceptor to develop the photoreceptor and form a first color image, the photoreceptor recharging to a second predetermined charge level, the second predetermined charge level being lower than the first predetermined charge level but being sufficiently high to subsequently repel liquid toner in areas not subsequently further discharged. Second image-wise exposing means exposes the with radiation modulated in accordance with the image data for another of the plurality of colors in order to partially discharge the photoreceptor to produce an image-wise distribution of charges on a surface of the photoreceptor corresponding to the image data for the another of the plurality of colors in registration with the first color image. Second application means applies a second color liquid toner to the image-wise distribution of charges on the photoreceptor to form a second color image in registration with the first color image. The first and second color images are then transferred together from the photoreceptor to the medium to form the multi-colored image.

In another embodiment of the present invention, the first image-wise exposing means and first liquid toner application means are repeated a total of three times corresponding to the first three color image planes of the multi-color image and then the second (now fourth) image-wise means and second (now fourth) toner application means are provided.

Preferably, the first color liquid toner is a liquid toner principally contains the color of yellow, wherein the second color liquid toner is a liquid toner principally contains the color of magenta, wherein the third color liquid toner is a liquid toner principally contains the color of cyan and wherein the fourth color liquid toner is a liquid toner principally contains the color of black.

BRIEF DESCRIPTION OF THE DRAWINGS

The foregoing advantages, construction and operation of the present invention will become more readily apparent from the following description and accompanying drawings in which.

DETAILED DESCRIPTION OF THE PREFERRED EMBODIMENTS

Liquid electrophotography is a technology which produces or reproduces an image on paper or other desired receptor material. Liquid electrophotography uses liquid inks which may be black or which may be of different colors for the purpose of plating solid material onto a surface in a well controlled and image-wise manner to create the desired prints. Typically, liquid inks used in electrophotography are substantially transparent or translucent to radiation emitted at the wavelength of the latent image generation device so that multiple image planes can be laid over one another to produce a multi-colored image constructed of a plurality of image planes with each image plane being constructed with a liquid ink of a particular color. Typically, a colored image is constructed of four image planes. The first three planes are constructed with a liquid ink in each of the three subtractive primary printing colors, yellow, cyan and magenta. The fourth image plane uses black ink which need not be transparent to radiation emitted at the wavelength of the latent image generation device.

Figure 1:
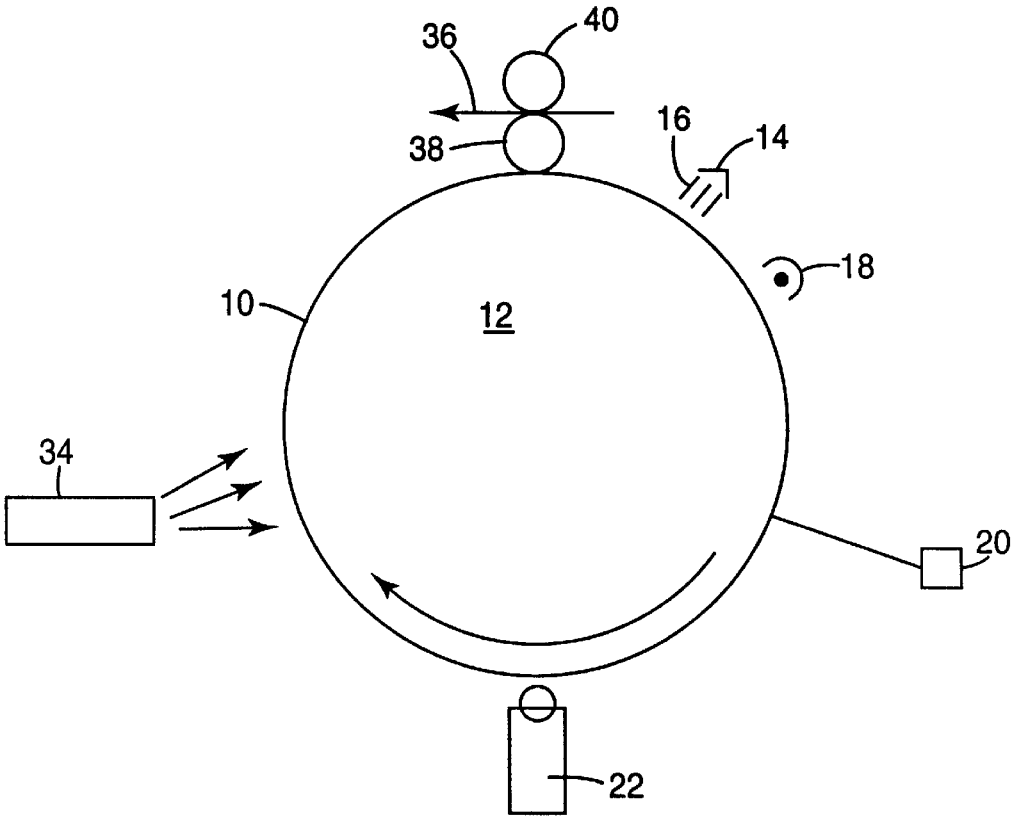
FIG. 1 is a diagrammatic illustration of a basic liquid electrophotographic process and apparatus for performing that process.

The process involved in liquid electrophotography can be illustrated with respect to a single color by reference to FIG. 1. Light sensitive, organic photoreceptor 10 is arranged on or near the surface of a mechanical carrier such as drum 12. The mechanical carrier could, of course, be a belt or other movable support object. Drum 12 rotates in the clockwise direction of FIG. 1 moving a given location of photoreceptor 10 past various stationary components which perform an operation relative to photoreceptor 10 or an image formed on drum 12.

Of course, other mechanical arrangements could be used which provide relative movement between a given location on the surface of photoreceptor 10 and various components which operate on or in relation to photoreceptor 10. For example, organic photoreceptor 10 could be stationary while the various components move past photoreceptor 10 or some combination of movement between both photoreceptor 10 and the various components could be facilitated. It is only important that there be relative movement between organic photoreceptor 10 and the other components. As this description refers to organic photoreceptor 10 being in a certain position or passing a certain position, it is to be recognized and understood that what is being referred to is a particular spot or location on organic photoreceptor 10 which has a certain position or passes a certain position relative to the components operating on photoreceptor 10.

In FIG. 1, as drum 12 rotates, organic photoreceptor 10 moves past erase lamp 14. When organic photoreceptor 10 passes under erase lamp 14, radiation 16 from erase lamp 14 impinges on the surface of photoreceptor 10 causing any residual charge remaining on the surface of photoreceptor 10 to "bleed" away. Thus, the surface charge distribution of the surface of photoreceptor 10 as it exits erase lamp 14 is quite uniform and nearly zero depending upon the photoreceptor.

As drum 12 continues to rotate and organic photoreceptor 10 next passes under charging device 18, such as a roll corona, a uniform positive or negative charge is imposed upon the surface of photoreceptor 10. In a preferred embodiment, the charging device 18 is a positive DC corona. Typically, the surface of photoreceptor 10 is uniformly charged to around 600 volts depending on the capacitance of photoreceptor. This prepares the surface of photoreceptor 10 for an image-wise exposure to radiation by laser scanning device 20 as drum 12 continues to rotate. Wherever radiation from laser scanning device 20 impinges on the surface of photoreceptor 10, the surface charge of photoreceptor 10 is reduced significantly while areas on the surface of photoreceptor 10 which do not receive radiation are not appreciably discharged. Areas of the surface of photoreceptor 10 which receive some radiation are discharged to a degree that corresponds to the amount of radiation received. This results in the surface of photoreceptor 10 having a surface charge distribution which is proportional to the desired image information imparted by laser scanning device 20 when the surface of photoreceptor 10 exits from under laser scanning device 20.

As drum 12 continues to rotate, the surface of photoreceptor 10 passes by liquid ink developer station 22. The operation of liquid ink developer station 22 can be more readily understood by reference to FIG. 2. Liquid ink 24 is applied to the surface of image-wise charged organic photoreceptor 10 in the presence of an electric field which is established by placing electrode 26, illustrated as a roller, near the surface of photoreceptor 10 and imposing a bias voltage on electrode 26. Liquid ink 24 consists of positively charged "solid", but not necessarily opaque, toner particles of the desired color for this portion of the image being printed. The "solid" material in the ink, under force from the established electric field, migrates to and plates upon the surface of photoreceptor 10 in areas 28 where the surface voltage is less than the bias voltage of electrode 26. The "solid" material in the ink will migrate to and plate upon the electrode in areas 30 where surface voltage of photoreceptor 10 is greater than the bias voltage of electrode 26. Excess liquid ink not sufficiently plated to either the surface of photoreceptor 10 or to electrode 26 is removed. A preferred means of removing this excess liquid ink is using the "crowned squeegee roller" described in copending U.S. patent application filed on even date herewith, entitled Squeegee Apparatus and Method for Removing Developer Liquid From an Imaging Substrate and Fabrication Method, identified by File No. 52066USA6A, the contents of which is hereby incorporated by reference.

The ink is further dried by drying mechanism 32 which may include a roll, vacuum box or curing station. Drying mechanism 32 substantially transforms liquid ink 24 into a substantially dry ink film. The excess liquid ink 24 then returns to liquid ink developer station 22 for use in a subsequent operation. The "solid" portion 28 (ink film) of liquid ink 24 plated upon the surface of photoreceptor 10 matches the previous image-wise charge distribution previously place upon the surface of photoreceptor 10 by laser scanning device 20 and, hence, is an image-wise representation of the desired image to be printed.

Referring again to FIG. 1, ink film 28 from liquid ink 24 is further dried by drying mechanism 34. Drying mechanism 34 may be passive, may utilize active air blowers or may be other active devices such as rollers. In a preferred embodiment, drying mechanism 34 is a drying roll or image conditioning roller. Such an apparatus is described in U.S. Pat. No. 5,420,675, which is hereby incorporated by reference.

The ink film 28 portion of liquid ink 24, representing the desired image to be printed, is then transferred, either directly to the medium 36 to be printed, or preferably and as illustrated in FIG. 1, indirectly by way of transfer rollers 38 and 40. Transfer is effected by differential tack of ink film 28 and transfer rollers 38 and 40. The preferred mechanism for image transfer is disclosed in copending U.S. Patent Application filed on even date herewith, in the names of Baker et al, entitled Method and Apparatus Having Improved Image Transfer Characteristics for Producing an Image On Plain Paper, identified by File No. 52067USA2A, the contents of which is hereby incorporated by reference. Typically, heat and pressure are utilized to fuse the image to medium 36. The resultant "print" is a hard copy manifestation of the image information written by laser scanning device 22 and is of a single color, the color represented by liquid ink 24.

Figure 2:
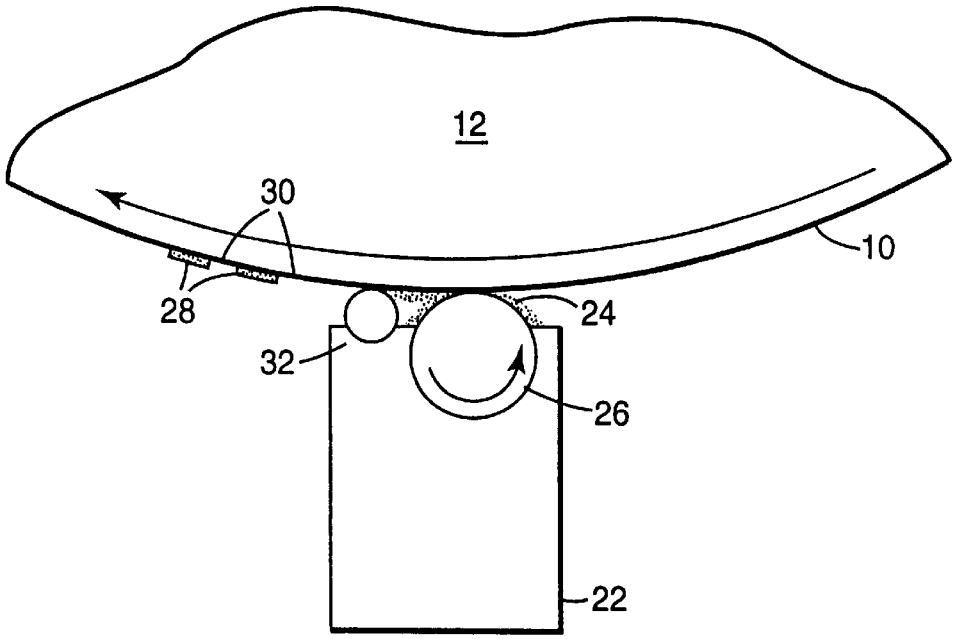
FIG. 2 is an expanded diagrammatic illustration of a liquid ink developer station used in the process and apparatus illustrated in FIG. 1.

While organic photoreceptor 10, drum 12, erase lamp 14, charging device 18, laser scanning device 20, liquid ink developer station 22, liquid ink 24, electrode 26, squeegee 32, drying mechanism 34 and transfer rollers 38 and 40 have been only diagrammatically illustrated in FIGS. 1 and 2 and only generally described with relation thereto, it is to be recognized and understood that these components are generally well known in the art of electrophotography and the exact material and construction of these elements is a matter of design choice which is also well understood in the art.

It is possible, of course, to make prints containing many colors rather than one single color. The basic liquid electrophotography process and apparatus described in FIGS. 1 and 2 can be used by repeating the process described above for one color, a number of times wherein each repetition may image-wise expose a separate primary color plane, e.g., cyan, magenta, yellow or black, and each liquid ink 24 may be of a separate primary printing color corresponding to the image-wise exposed color plane. Superposition of four such color planes may be achieved with good registration onto the surface of photoreceptor 10 without transferring any of the color planes until all have been formed. Subsequent simultaneous transfer of all of these four color planes to a suitable medium 36 may yield a quality color print. Such as process and apparatus is described in U.S. Pat. No. 4,728,983, Zwadlo et al, Single Beam Full Color Electrophotography, assigned to the assignee of this application, which patent is hereby incorporated by reference.

While the above described liquid electrophotography process is suitable for construction of a multi-colored image, the process is somewhat slow because photoreceptor 10 must repeat the entire sequence for each color of the typical four color colored image. When the above process is performed for a particular color, e.g., cyan, laser scanning device 20 causes areas 20 photoreceptor 10 receiving radiation to at least partially discharged to create a surface charge distribution pattern of the surface of photoreceptor 10 which represents the portion of the image to be reproduced representing that particular color, e.g., cyan. After development by liquid developer station 22, the surface charge distribution of photoreceptor 10 is still quite variable (assuming at least some pattern to the image to be reproduced) and too low to be subsequently imaged. Photoreceptor 10 then must be erased to make the surface charge distribution uniform and must be again charged to provide a sufficient surface charge to allow a subsequent development process to plate liquid ink upon areas 28 of photoreceptor 10.

With the electrophotography system of the present invention, liquid ink 24 contains conventional "solid" colored toner particles and also contains transparent counter ions. The conventional "solid" colored toner particles in liquid ink 24 plate to the surface of photoreceptor 10 while the transparent counter ions in liquid ink 24 plate in the opposite direction, i.e., the transparent counter ions plate to the surface of photoreceptor 10 in areas 30 which are not discharged. Conventional "solid" colored toner particles in liquid ink 24 plate to electrode 26 in charged areas 30 while transparent counter ions plate to electrode 26 in areas 28.

Prior to development, photoreceptor 10 is charged similarly by charging device 18, after which photoreceptor 10 may be exposed image-wise to radiation such as from laser scanning device 20 such that the charge distribution over the surface of photoreceptor 10 is rendered proportional to predetermined image information. Then liquid ink 24 is applied to the charge distribution on the photoreceptor 10 in the presence of a well controlled electric field provided by liquid developer station 22. This deposits a solid material of a predetermined color onto the surface of photoreceptor 10 which is distributed in a manner which is proportional to the predetermined image information. In like manner, transparent counter-ions are deposited onto the surface of photoreceptor 10 in a distribution which is inversely proportional to the predetermined image information. The presence of such counter-ions provides a charge distribution on the surface of the photoreceptor as it leaves the electric field which is well controlled and substantially uniform and is not substantially modulated by the image-wise distribution which was on the surface as it entered the electric field. This process, which effectively "develops" an image of a prescribed color serves as the charging means for a next color such that conventional erase and charge means (such as from an erase lamp and a charging corona) are not required in order to expose and develop a next color plane.

Figure 3A:
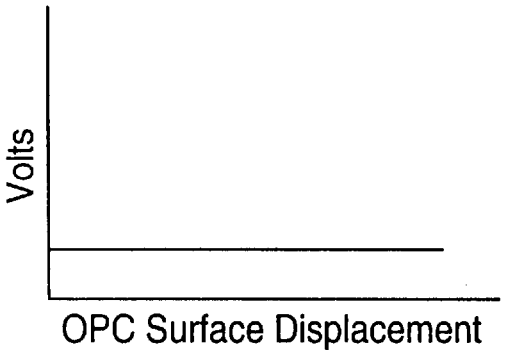
FIG. 3*a* is a graph illustrating the surface charge of the organic photoreceptor of FIGS. 1 and 2 existing after erase and before charging.
Figure 3B:
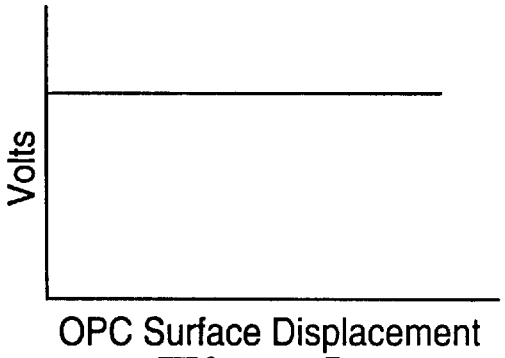
FIG. 3*b* is a graph illustrating the surface charge of the organic photoreceptor of FIGS. 1 and 2 existing after charging and before image-wise exposure.
Figure 3C:
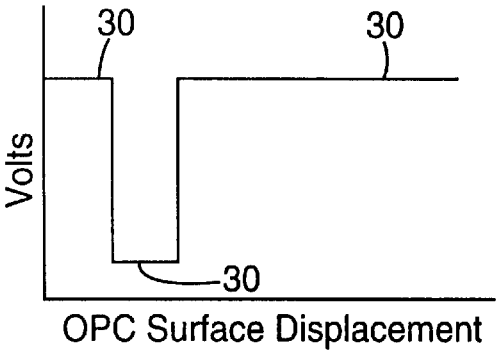
FIG. 3*c* is a graph illustrating the surface charge of the organic photoreceptor of FIGS. 1 and 2 existing after image-wise exposure and before development.
Figure 3D:
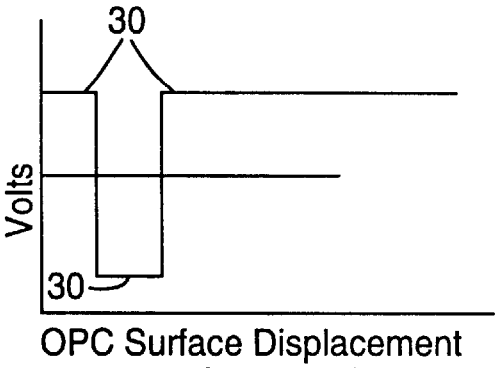
FIG. 3*d* is a graph illustrating the surface charge of the organic photoreceptor of FIGS. 1 and 2 existing during development.
Figure 3E:
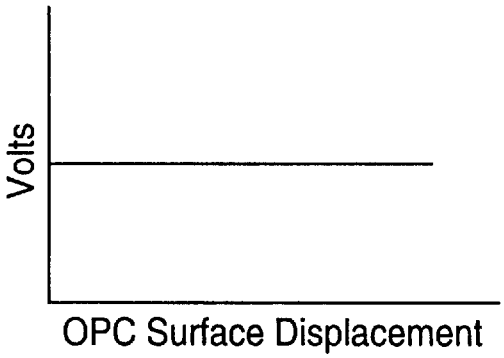
FIG. 3*e* is a graph illustrating the surface charge of the organic photoreceptor of FIGS. 1 and 2 existing after development.

This solution charge exchange charging of photoreceptor 10 is illustrated in FIGS. 3*a*, 3*b*, 3*c*, 3*d* and 3*e*. As illustrated in FIG. 3*a*, the surface of organic photoreceptor 10 after erase and before corona charging is uniform and low, preferably nearly zero. As illustrated in FIG. 3*b*, the surface of photoreceptor 10 after corona charging and before image-wise exposure is uniform and high, preferably about 600volts depending on the capacitance of the photoreceptor. As illustrated in FIG. 3*c*, the surface of photoreceptor 10 after image-wise is discretely variable with areas 28 having been exposed to radiation having been discharged to a quite low level and areas 30 which have not been exposed to radiation still remaining at a high voltage, again preferably near 600 volts depending upon capacitance. As illustrated in FIG. 3*d*, the surface of photoreceptor 10 during development shows that as solids in liquid ink 24 plate onto the surface of photoreceptor 10 in areas 28, charge migration causes the voltage existing on the surface of organic photoreceptor 10 to increase. As solids from liquid ink 24 in areas 30 plate onto electrode 26, charge migration causes the voltage existing on the surface of organic photoreceptor 10 to decrease. The result, illustrated in FIG. 3*e*, shows that the surface of photoreceptor 10 after development is relatively uniform and equal to the bias voltage level of electrode 26.

Figure 4:
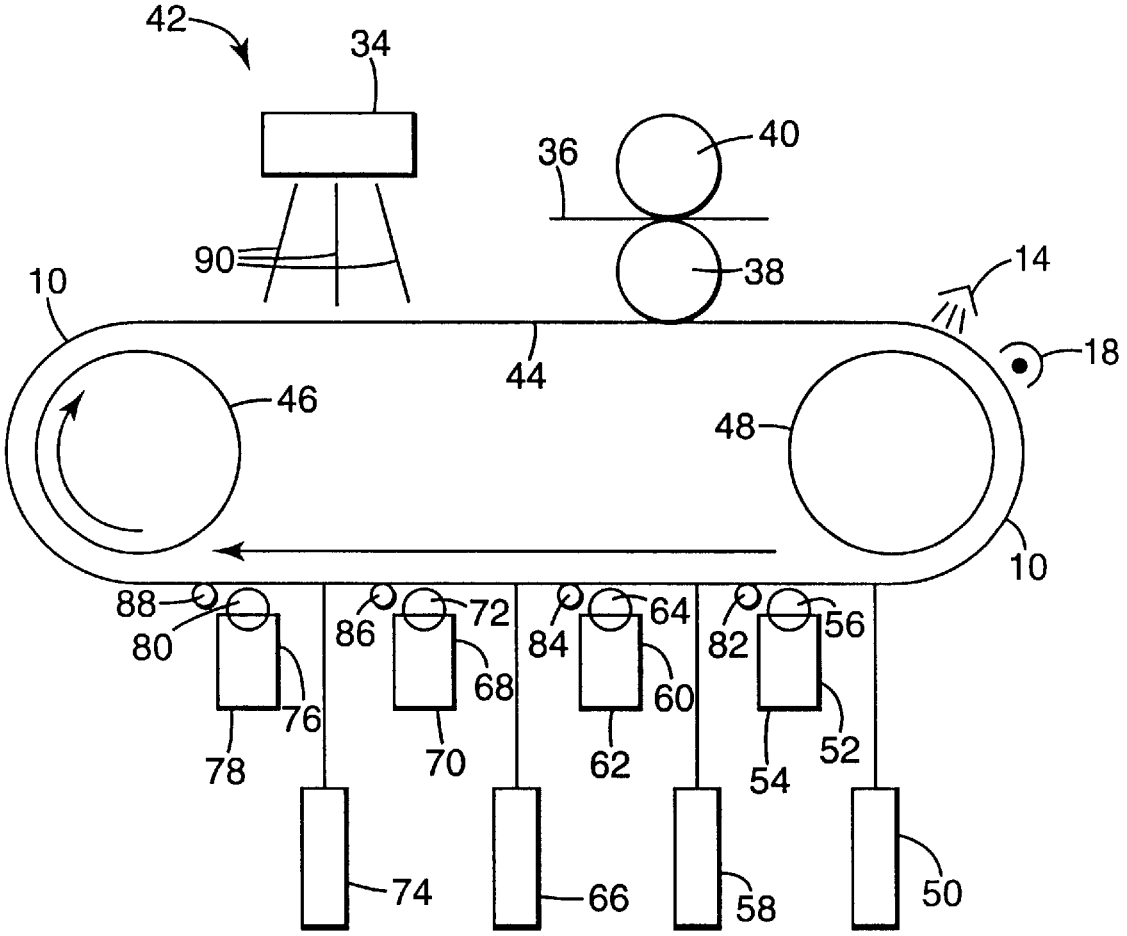
FIG. 4 is a diagrammatic illustration of an apparatus and method for producing a multi-colored image in accordance with the present invention.

While not required by all embodiments of the present invention, FIG. 4 diagrammatically illustrates an apparatus 42 and method for producing a multi-colored image. Photoreceptor 10 is mechanically supported by belt 44 which rotates in a clockwise direction around rollers 46 and 48. Photoreceptor 10 is first conventionally erased with erase lamp 14. Any residual charge left on photoreceptor 10 after the preceding cycle is preferably removed by erase lamp 14 and then conventionally charged using charging device 18, such procedures being well known in the art. When so charged, the surface of photoreceptor 10 is uniformly charged to around 600 volts, preferably. Laser scanning device 50, similar to laser scanning device 20 illustrated in FIG. 1, exposes the surface of photoreceptor 10 to radiation in an image-wise pattern corresponding to a first color plane of the image to be reproduced.

With the surface of photoreceptor so image-wise charged, charged pigment particles in liquid ink 54 corresponding to the first color plane will migrate to and plate upon the surface of photoreceptor 10 in areas where the surface voltage of photoreceptor 10 is less than the bias of electrode 56 associated with liquid ink developer station 52. The charge neutrality of liquid ink 54 is maintained by negatively charged counter ions which balance the positively charged pigment particles. Counter ions are deposited on the surface of photoreceptor 10 in areas where the surface voltage is greater than the bias voltage of electrode 56 associated with liquid ink developer station 52.

At this stage, photoreceptor 10 contains on its surface an image-wise distribution of plated "solids" of liquid ink 52 in accordance with a first color plane. The surface charge distribution of photoreceptor 10 has also been recharged with plated ink particles as well as with transparent counter ions from liquid ink 52 both being governed by the image-wise discharge of photoreceptor 10 due to laser scanning device 58. Thus, at this stage the surface charge of photoreceptor 10 is also quite uniform. Although not all of the original surface charge of photoreceptor may have been obtained, a substantial portion of the previous surface charge of photoreceptor has been recaptured. With such solution recharging, photoreceptor 10 is now ready to be processed for the next color plane of the image to be reproduced.

As belt 44 continues to rotate, organic photoreceptor 10 next is image-wise exposed to radiation from laser scanning device 58 corresponding to a second color plane. Note that this process occurs during a single revolution of organic photoreceptor 10 by belt 44 and without the necessity of photoreceptor 10 being subjected to erase subsequent to exposure to laser scanning device 50 and liquid ink development station 52 corresponding to a first color plane. The remaining charge on the surface of photoreceptor 10 is subjected to radiation corresponding to a second color plane. This produces an image-wise distribution of surface charge on photoreceptor 10 corresponding to the second color plane of the image.

The second color plane of the image is then developed by developer station 60 containing liquid ink 62. Although liquid ink 62 contains "solid" color pigments consistent with the second color plane, liquid ink 62 also contains substantially transparent counter ions which, although they may have differing chemical compositions than substantially transparent counter ions of liquid ink 54, still are substantially transparent and oppositely charged to the "solid" color pigments. Electrode 64 provides a bias voltage to allow "solid" color pigments of liquid ink 62 create a pattern of "solid" color pigments on the surface of photoreceptor 10 corresponding to the second color plane. The transparent counter ions also substantially recharge photoreceptor 10 and make the surface charge distribution of photoreceptor 10 substantially uniform so that another color plane may be placed upon photoreceptor 10 without the necessity of erase nor corona charging.

A third color plane of the image to be reproduced is deposited on the surface of photoreceptor 10 is similar fashion using laser scanning device 64 and developer station 66 containing liquid ink 68 using electrode 70. Again, the surface charge existing on photoreceptor 10 following development of the third color plane may be somewhat less than existed prior to exposure to laser scanning device 64 but will be substantially "recharged" and will be quite uniform allowing application of the fourth color plane without the necessity of erase or corona charging.

Similarly, a fourth color plane is deposited upon photoreceptor 10 using laser scanning device 74 and developer station 76 containing liquid ink 78 using electrode 80.

Preferably, excess liquid from liquid inks 54, 62, 70 and 78 is "squeezed" off using a roller similar to roller 32 described with respect to FIG. 1. Such a roller may be used in conjunction with any of developer stations 52, 60, 68 or 76 or all of them.

The plated solids from liquid inks 54, 62, 70 and 78 are dried in a drying mechanism 34 similar to that described with respect to FIG. 1. Drying mechanism 34 may be passive, may utilize active air blowers or may be other active devices such as drying rollers, vacuum devices, coronas, etc.

The completed four color image is then transferred, either directly to the medium 36 to be printed, or preferably and as illustrated in FIG. 4, indirectly by way of transfer rollers 38 and 40. Typically, heat and/or pressure are utilized to fix the image to medium 36. The resultant "print" is a hard copy manifestation of the four color image.

With proper selection of charging voltages, photoreceptor capacity and liquid ink, this process may be repeated an indeterminate number of times to produce a multi-colored image having an indeterminate number of color planes. Although the process and apparatus has been described above for conventional four color images, the process and apparatus are suitable for multi-color images having two or more color planes.

Photoreceptor 10 may be a photoconductive layer applied to an electroconductive substrate, an interlayer applied to the photoconductive layer, and a release layer over the interlayer. The release layer may be a swellable polymer. By swellable is meant that the polymer is capable of absorbing carrier liquid in amounts greater than 50% of the weight of the polymer. If desired, the release layer may have rough surface, preferably with an $R_a$ from about 10 nanometers to about 100 nanometers.

The release layer may be a swellable polymer formed by cross linking a high molecular weight hydroxy terminated siloxane. More preferably, the release layer is the reaction product of a high molecular weight hydroxy terminated siloxane, a low molecular weight hydroxy terminated siloxane, and a cross-linking agent. If such a combination is used, the weight ratio of high molecular weight hydroxy terminated siloxane to low molecular weight hydroxy terminated siloxane is preferably in the range from 0.5:1 to 100:1, more preferably in the range from 1:1 to 20:1.

A preferred embodiment for photoreceptor 10 is described in Example 6 of copending U.S. patent application Ser. No. 08/431,022, which is hereby incorporated by reference.

Charging device 18 is preferably a scorotron type corona charging device. Charging device 18 has grid wires (not shown) coupled to a suitable positive high voltage source of plus 4,000 to plus 8,000 volts. The grid wires of charging device 18 are disposed from about 1 to about 3 millimeters from the surface of photoreceptor 10 and are coupled to an adjustable positive voltage supply (not shown) to obtain an apparent surface voltage on photoreceptor 10 in the range plus 600 volts to plus 1000volts or more depending upon the capacitance of photoreceptor. While this is the preferred voltage range, other voltages may be used. For example, thicker photoreceptors typically require higher voltages. The voltage required depends principally on the capacitance of photoreceptor 10 and the charge to mass ratio of the liquid ink utilized as the toner for apparatus 42. Of course, connection to a positive voltage is required for a positive charging photoreceptor 10. Alternatively, a negatively charging photoreceptor 10 using negative voltages would also be operable. The principles are the same for a negative charging photoreceptor 10.

Laser scanning device 50 imparts image information associated with a first color plane of the image, laser scanning device 58 imparts image information associated with a second color plane of the image, laser scanning device 66 imparts image information associated with a third color plane of the image and laser scanning device 74 imparts image information associated with a fourth color plane of the image. Although each of laser scanning devices 50, 58, 66 and 74 are associated with a separate color of the image and operate in the sequence as described above with reference to FIG. 4, for convenience they are described together below.

Laser scanning devices 50, 58, 66 and 74 include a suitable source of high intensity electromagnetic radiation. The radiation may be a single beam or an array of beams. The individual beams in such an array may be individually modulated. The radiation impinges, for example, on photoreceptor 10 as a line scan generally perpendicular to the direction of movement of photoreceptor 10 and at a fixed position relative to charging device 18.

The radiation scans and exposes photoreceptor 10 preferably while maintaining exact synchronism with the movement of photoreceptor 10. The image-wise exposure causes the surface charge of photoreceptor 10 to be reduced significantly wherever the radiation impinges. Areas of the surface of photoreceptor 10 where the radiation does not impinge are not appreciably discharged. Therefore, when photoreceptor 10 exits from under the radiation, its surface charge distribution is proportional to the desired image information.

The wavelength of the radiation to be transmitted by laser scanning devices 50, 58 and 66 is selected to have low absorption through the first three color planes of the image. The fourth image plane is typically black. Black is highly absorptive to radiation of all wavelengths which would be useful in the discharge of photoreceptor 10. Additionally, the wavelength of the radiation of laser scanning devices 50, 58, 66 and 74 selected should preferably correspond to the maximum sensitivity wavelength of photoreceptor 10. Preferred sources for laser scanning devices 50, 58, 66 and 74 are infrared diode lasers and light emitting diodes with emission wavelengths over 700nanometers. Specially selected wavelengths in the visible may also be usable with some combinations of colorants. The preferred wavelength is 780 nanometers.

The radiation (a single beam or array of beams) from laser scanning devices 50, 58, 66 and 74 is modulated conventionally in response to image signals for any single color plane information from a suitable source such as a computer memory, communication channel, or the like. The mechanism through which the radiation from laser scanning devices is manipulated to reach photoreceptor 10 is also conventional.

The radiation strikes a suitable scanning element such as a rotating polygonal mirror (not shown) and then passes through a suitable scan lens (not shown) to focus the radiation at a specific raster line position with respect to photoreceptor 10. It will of course be appreciated that other scanning means such as an oscillating mirror, modulated fiber optic array, waveguide array, or suitable image delivery system may be used in place of or in addition to a polygonal mirror. For digital halftone imaging, it is preferred that radiation should be able to be focused to diameters of less than 42 microns at the one-half maximum intensity level assuming a resolution of 600 dots per inch. A lower resolution may be acceptable for some applications. It is preferred that the scan lens must be able to maintain this beam diameter across at least a 12 inches (30.5 centimeters) width.

The polygonal mirror typically is rotated conventionally at constant speed by controlling electronics which may include a hysteresis motor and oscillator system or a servo feedback system to monitor and control the scan rate. Photoreceptor 10 is moved orthogonal to the scan direction at constant velocity by a motor and position/velocity sensing devices past a raster line where radiation impinges upon photoreceptor 10. The ratio between the scan rate produced by the polygonal mirror and photoreceptor 10 movement speed is maintained constant and selected to obtain the required addressability of laser modulated information and overlap of raster lines for the correct aspect ratio of the final image. For high quality imaging, it is preferred that the polygonal mirror rotation and photoreceptor 10 speed are set so that at least 600 scans per inch, and still more preferably 1200 scans per inch, are imaged on photoreceptor 10. It is preferable not to have photoreceptor 10 travel substantially faster than about 3 inches/second (7.6 centimeters/second).

Developer station 52 develops the first color plane of the image, developer station 60 develops the second color plane of the image, developer station 68 develops the third color plane of the image and developer station 76 develops the fourth color plane of the image. Although each of developer stations 52, 60, 68 and 76 are associated with a separate color of the image and operate in the sequence as described above with reference to FIG. 4, for convenience they are described together below.

Conventional liquid ink immersion development techniques are used in developer stations 52, 60, 68 and 76. Two modes of development are known in the art, namely deposition of liquid ink 54, 62, 70 and 78 in exposed areas of photoreceptor 10 and, alternatively, deposition of liquid ink 54, 62, 70 and 78 in unexposed regions. The former mode of imaging can improve formation of halftone dots while maintaining uniform density and low background densities. Although the invention has been described using a discharge development system whereby the positively charged liquid ink 54, 62, 70 and 78 is deposited on the surface of photoreceptor 10 in areas discharged by the radiation, it is to be recognized and understood that an imaging system in which the opposite is true is also contemplated by this invention. Development is accomplished by using a uniform electric field produced by development electrodes 56, 64, 72 and 80 spaced near the surface of photoreceptor 10.

Developer stations 52, 60, 68 and 76 consist of a developer roll, squeegee roller 82, 84, 86 and 88, fluid delivery system, and a fluid return system. A thin, uniform layer of liquid ink 54, 62, 70 and 78 is established on a rotating, cylindrical developer roll (electrode) 56, 64, 72 and 80. A bias voltage is applied to the developer roll (electrode) intermediate to the unexposed surface potential of photoreceptor 10 and the exposed surface potential level of photoreceptor 10. The voltage is adjusted to obtain the required maximum density level and tone reproduction scale for halftone dots without any background being deposited. Developer roll (electrode) 56, 64, 72 and 80 is brought into proximity with the surface of photoreceptor 10 immediately before the latent image formed on the surface of photoreceptor 10 passes beneath the developer roll (electrode) 56, 64, 72 and 80. The bias voltage on developer roll (electrode) 56, 64, 72 and 80 forces the charged pigment particles, which are mobile in the electric field, to develop the latent image. The charged "solid" particles in liquid ink 54, 62, 70 and 78 will migrate to and plate upon the surface of photoreceptor 10 in areas where the surface charge of photoreceptor 10 is less than the bias voltage of developer roll (electrode) 56, 64, 72 and 80. The charge neutrality of liquid ink 54, 62, 70 and 78 is maintained by oppositely-charged substantially transparent counter ions which balance the charge of the positively charged ink particles. Counter ions are deposited on the surface photoreceptor 10 in areas where the surface voltage of photoreceptor 10 is greater than the electrode bias voltage.

After plating is accomplished by developer roll (electrode) 56, 64, 72 and 80, squeegee rollers 82, 84, 86 and 88 then rolls over the developed image area on photoreceptor 10 removing the excess liquid ink 54, 62, 70 and 78 and successively leaving behind each developed color plane of the image. Alternatively, sufficient excess liquid ink remaining on the surface of photoreceptor 10 could be removed in order to effect film formation by vacuum techniques well known in the art. The ink deposited onto photoreceptor 10 should be rendered relatively firm (film formed) by the developer roll (electrode) 56, 64, 72 and 80, squeegee rollers 82, 84, 86 and 88 or an alternative drying technique in order to prevent it from being washed off in a subsequent developing process(es) by developer stations 60, 68 and 76. Preferably, the ink deposited on photoreceptor should be dried enough to have greater than seventy-five percent by volume fraction of solids in the image.

Preferred squeegee rollers 82, 84, 86 and 88 are described in copending U.S. patent application filed on even date herewith in the names of Moe et al, entitled Squeegee Apparatus and Method for Removing Developer Liquid from an Imaging Substrate and Fabrication Method, identified by File No. 52066USA4A, which is hereby incorporated by reference. Developer rolls (electrodes) 56, 64, 72 and 80 are kept clean by a developer cleaning roller as described in copending U.S. patent application filed on even date herewith, entitled Apparatus and Method for Cleaning Developer from an Imaging Substrate, identified by File No. 51517USA8A, which is hereby incorporated by reference. Any further excess ink is removed by an additional roller described in copending U.S. patent application filed on even date herewith, entitled Apparatus and Method for Removing Excess Ink from an Imaging Substrate, identified by File No. 52065USA6A, which is hereby incorporated by reference. The overall developer apparatus is described in detail in copending U.S. Patent Application filed on even date herewith in the names of Teschendorf et al, entitled Development Apparatus for an Electrographic System, identified by File No. 52064USA8A, which is hereby incorporated by reference.

Developer stations 52, 60, 68 and 76 are similar to that described in U.S. Pat. No. 5,300,990, Thompson et al, which is hereby incorporated by reference. The preferred developer stations 52, 60, 68 and 76 differ from those described in the Thompson et al patent in that the preferred spacing between the developer roll surface and the surface of photoreceptor 10 is 150 microns (0.15 millimeters) instead of 50–75 microns (0.05–0.075 millimeters). Further, no wiper roller is used and squeegee rollers 82, 84, 86 and 88 are made of urethane. Once the development process for each color plane of the image is complete, the appropriate developer roll (electrode) 56, 64, 72 and 80 is retracted from the surface of photoreceptor 10, breaking the contact between liquid inks 54, 62, 70 and 78 and the surface of photoreceptor 10. The developer rolls (electrode) 56, 64, 72 and 80 dripline fluid is removed and captured by squeegee rollers 82, 84, 86 and 88.

The dripline of liquid inks 54, 62, 70 and 78 supplied by developer rolls (electrode) 56, 64, 72 and 80 on photoreceptor 10 advances toward squeegee rollers 82, 84, 86 and 88 as photoreceptor 10 moves on belt 44 and combines with liquid inks 54, 62, 70 or 78, respectively, already contained at the leading edge of squeegee rollers 82, 84, 86 and 88 (squeegee holdup volume). The excess liquid inks 54, 62, 70 and 78 from the dripline and the squeegee holdup volume will overflow down the front surface of squeegee rollers 82, 84, 86 and 88, a portion of it flowing into the fluid return system. After the imaged area of photoreceptor 10 is past squeegee rollers 82, 84, 86 and 88, a doctor blade (not shown) is brought into contact with the bottom of each squeegee roller 82, 84, 86 and 88. At the same time, squeegee rollers 82, 84, 86 and 88 begin rotating in the direction opposite the moving surface of photoreceptor 10 with a velocity of approximately 10 inches per second (25.4 centimeters per second). The fluid of liquid inks 54, 62, 70 and 78 in the nip of squeegee rollers 82, 84, 86 and 88 is taken away from the surface of photoreceptor 10 by the motion of squeegee rollers 82, 84, 86 and 88 and skived off squeegee rollers 82, 84, 86 and 88 by the doctor blade, from which it drains into the fluid return system. The rate at which the liquid ink 54, 62, 70 or 78 can be removed is a function of the velocity ratio of the surface of photoreceptor 10 to the surface of squeegee rollers 82, 84, 86 and 88. It is preferred that the doctor blade maintain intimate contact with the entire lateral width of the squeegee rollers 82, 84, 86 and 88 so that the doctor blade cannot swell or warp. The preferred material for the doctor blade is 3M brand Fluoroelastomer FC 2174, which is inert to liquid ink, manufactured by Minnesota Mining and Manufacturing Company, St. Paul, Minn.

If the composition of liquid inks 54, 60, 70 and 78 and the parameters governing the time constants in the development process are appropriately selected, the surface potential distribution on photoreceptor 10 as it exits from developer stations 52, 60 and 68 may be uniform and nearly equal to the bias voltage on electrode 56, as a result of the deposition of positively charged pigment particles in the areas where the surface potential of photoreceptor 10 was less than the bias of electrode 56 (imaged areas) and the deposition of negatively charged counter ions in the areas where the surface potential of photoreceptor 10 was greater than the bias of electrode 56 (non-imaged areas).

Erase lamp 14 or charging device 18 are not necessary before exposing a subsequent color planes of the image. If the bias voltage of electrode 56 for the first color plane is carefully selected such that the charge distribution on photoreceptor 10 as it exits developer station 52 is of necessary and sufficient amplitude to serve as the charge-up value for the second color plane of the image.

The latent image for the second color separation, formed by the second color plane of the image, is then developed in the same manner as described for the first color separation. The exposure and development steps may be repeated a number of times wherein each repetition may image-wise expose a separate color plane, such as cyan, magenta, yellow, or black, and each development ink may be of a separate color corresponding to the image-wise exposed color plane. Superposition of four such color planes may be achieved with good registration onto a photoreceptor surface without transferring any of the planes until all have been formed. The order of imaging and developing for the individual color separations of the full color image is not fixed but may be chosen to suit the process in hand and depends only on the final image requirements.

Figure 5:
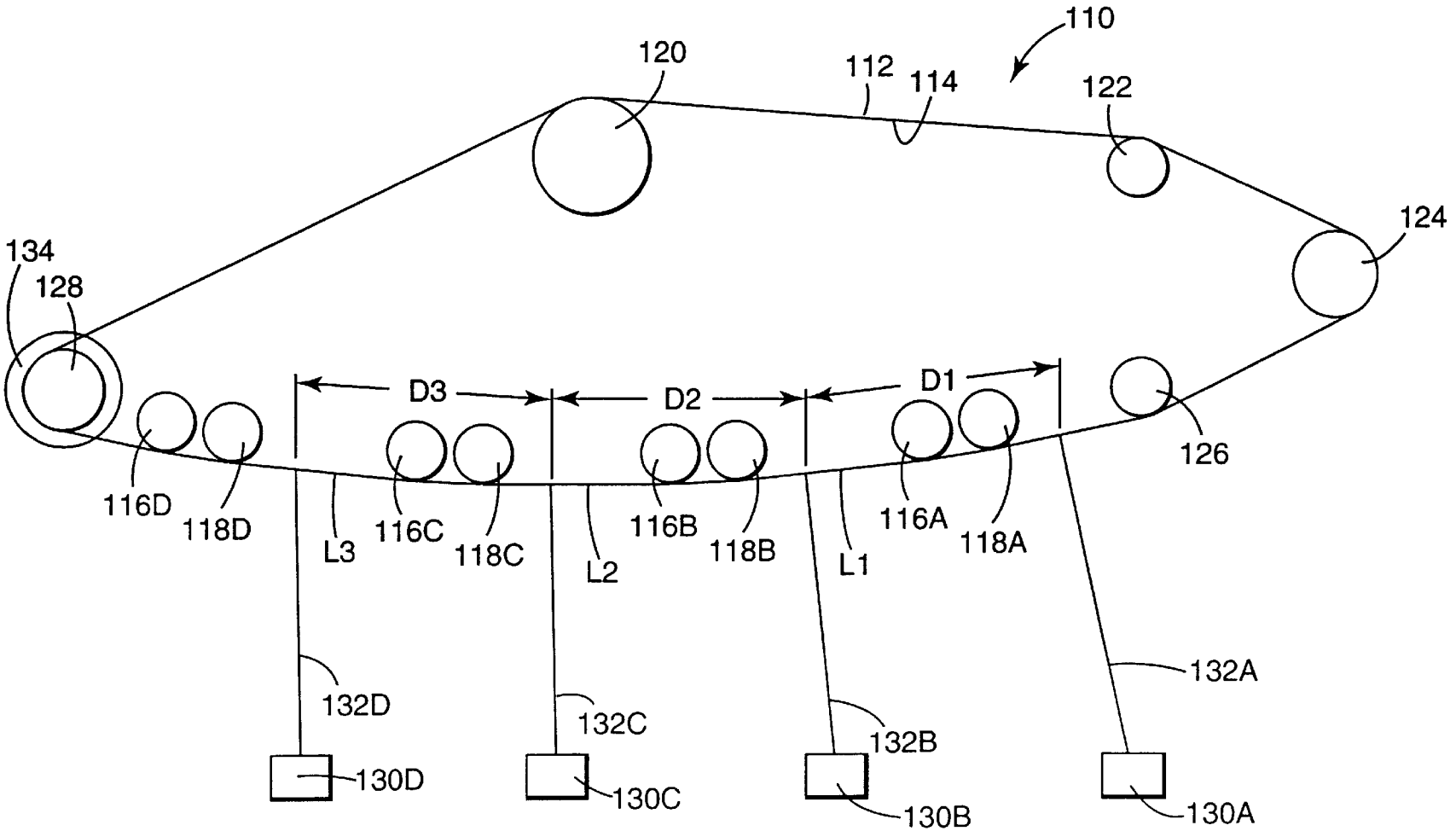
FIG. 5 is a more detailed illustration of the belt handling portion of the apparatus illustrated in FIG. 1.

FIG. 5 illustrates a photoreceptor in the form of a photoreceptive belt 110. The photoreceptive belt 110 has a belt outer surface 112 and a belt inner surface 114. FIG. 5 also illustrates one embodiment of a belt path created by thirteen rolls. The photoreceptive belt 110 can move along the belt path in a clockwise direction (and can reverse to counter-clockwise direction during a cleaning step). The thirteen rolls include four squeegee back-up rolls 116A–D which provide support for four squeegee rolls (not shown, but positioned adjacent to the belt outer surface 112). Four developer back-up rolls 118A–D contact the belt inner surface 114 and are positioned opposite to four developer rolls (not shown, but positioned adjacent to the belt outer surface 112). A transfer back-up roll 120 provides support for a transfer roll (not shown, but positioned adjacent to the belt outer surface 112). A first belt-locating roll 122 is positioned between the transfer back-up roll 120 and a belt-steering roll 124 to fix the location of the photoreceptive belt 110 relative to a charging device (not shown, but positioned adjacent to the belt outer surface 112). The belt-steering roll 124 can be biased such that the photoreceptive belt 110 is under tension. A second belt-locating roll 126 is positioned between the belt-steering roll 124 and the first developer backup roll 118A to fix the location of the photoreceptive belt 110 relative to a first imaging device (not shown, but positioned adjacent to the belt outer surface 112). The second belt-locating roll 126 is a back-up roll providing support for a cleaning device (not shown, but positioned adjacent to the belt outer surface 112). A drive roll 128 is driven in a clockwise fashion and drives the photoreceptive belt 110 about the belt path. The drive roll 128 can also provide support for a drying roll (not shown, but positionable adjacent to the belt outer surface 112).

The four squeegee back-up rolls 116A–D, the four developer back-up rolls 118A–D, the transfer back-up roll 120, and the first and second belt-locating rolls 122, 126 are idler rolls and can include dead shafts (not shown) to provide non-rotating alignment reference for mating rolls such as the squeegee, developer, cleaning, and transfer rolls. These rolls could, instead, include live shafts with bearing devices mounted on the journals (not shown).

The thirteen rolls are positioned such that photoreceptive belt 110 contacts at least three degrees of the circumference of each roll. However, the photoreceptive belt 110 is shown as contacting significantly more than three degrees of the of the circumferences of the transfer back-up roll 120, the first belt-locating roll 122, the belt-steering roll 124, the second belt-locating roll 126 and the drive roll 128.

The diameter of the squeegee back-up rolls 116A–D, the developer back-up rolls 118A–D, and the first and second belt-locating rolls 122, 126 can be, for example, approximately 0.75 inch (1.59 centimeters), or 1.0 inch (2.54 centimeters). The diameter of the transfer back-up roll 120 can be, for example, approximately 1.50 inches (3.81 centimeters). The diameter of the belt-steering roll 124 can be, for example, approximately 1.10 inches (2.79 centimeters). The diameter of the drive roll 128 can be, for example, approximately 1.053 inches (2.67 centimeters). The belt thickness can be, for example, 0.004 inch (0.01 centimeter).

The distance from the outside portion of the drive roll 128 (the portion contacting the photoreceptive belt 110) to the outside portion of the belt-steering roll 124 (the portion contacting the photoreceptive belt 110) can be approximately 16.9 inches (42.93 centimeters). FIG. 5, being proportionately illustrated, shows the approximate location of each roll relative to the other rolls. For example, the arched spacing between the first and second developer back-up rolls 118A, B is the same as the arched spacing between the second and third developer back-up rolls 118B,C and the arched spacing between the third and fourth developer back-up rolls 11 8C,D.

FIG. 5 also illustrates four laser scanning devices 130A–D. These devices 130A–D produce four corresponding laser beams 132A–D which strike the photoreceptive belt 110. The distances D1–3 between the locations where the laser beams 132A–D strike the photoreceptive belt 110 are important for accurately registering the image applied to the photoreceptive belt 110 by the first laser beam 132A with the images applied to the photoreceptive belt 110 by the second, third, and fourth laser beams 132B–D.

The laser scanning devices 130A–D are configured and the distances D1–3 are set such that the length L1 of the photoreceptive belt 110 between where the first and second laser beams 132A,B strike the photoreceptive belt is approximately 3.33 inches (8.46 centimeters), the length L2 of photoreceptive belt 110 between the locations where the second and third laser beams 132B,C strike the photoreceptive belt 110 is approximately 3.33 inches (8.46 centimeters), and the length L3 of the photoreceptive belt 110 between the locations where the third and fourth laser beams 132C,D strike the photoreceptive belt 110 is approximately 3.33 inches (8.46 centimeters). As a result, these lengths L1–3 are very close to being, if not exactly, equal to the product of Pi and the effective diameter of the drive roll 128 when wrapped with the photoreceptive belt 110 (the product of 3.14159×(1.053+0.004+0.004 inches)=3.333 inches).

The match between the lengths L1–3 and the circumference can be very important because the drive roll 128 (the drive roll) can itself be imperfect or it can be mounted imperfectly. This imperfection can cause the velocity of the photoreceptive belt 110 to vary within each revolution of the drive roll 128 (i.e., the velocity variation is cyclical with the revolution of the drive roll 128). An example of such an imperfection could be the imperfect roundness of the drive roll 128. Another example could be the concentricity of the drive roll 128 relative to the journal bearings (not shown) of the drive roll 128. The velocity variation results in image variation. However, the match of the lengths L1–3 and the circumference causes the variation within the image created by the first laser beam 132A to be registered, if you will, with the variation within the image created by the second, third, and fourth laser beams 132B–D. Although the variation within a single image created by a single laser beam may not be visible (i.e., not visibly significant), inaccurate registration of four images created by the four laser beams can be very visible (i.e., visibly significant).

The drive roll 128 can be directly coupled to and driven by a stepper motor 134. A standard stepper motor 134 has 200 poles that define the discrete rotational positions or steps. Stepper motor dirvers bias the poles forcing the motor to take full or partial steps. If the stepper motor 134 were microstepped to provide, for example, 2000 steps to revolve the drive roll 128 (3.33-inch circumference), the photoreceptive belt would be driven a distance of 1.0 inch (2.54 centimeters) for every 600 steps (assuming zero slippage). If the laser beams 132A–D are scanned with each step, the laser scanning resolution of this arrangement is 600 lines per inch.

Rather than making the circumference of the drive roll 128 equal to the lengths L1–3, accurate registration could be accomplished by making the lengths L1–3 equal to any integer multiple of the circumference of the drive roll 128.

Consequently, a number of arrangements can be made which coordinate the driving of the photoreceptive belt 110 with the lengths. And, larger or smaller circumferences and shorter or longer lengths could be used rather than the 3.33-inch (8.46-centimeter) dimension. This dimension can be chosen based on the size constraint or preference of the apparatus which includes the belt 110 and rollers; based on the availability of various roll sizes and various stepper motor 134 configurations; based on laser spacing constraints or preferences; and based on other constraints or preferences (such as directly coupling the stepper to the drive roll 128 or including the cost and componentry for gearing the two).

In addition, drive means other than the stepper motor 134 and the drive roll 128 could be used and still provide the above-noted means for providing accurate registration. For example, the drive roll 128 could be replaced by a small driven belt (not shown). Many other modifications are envisioned as part of this invention.

Figure 6:
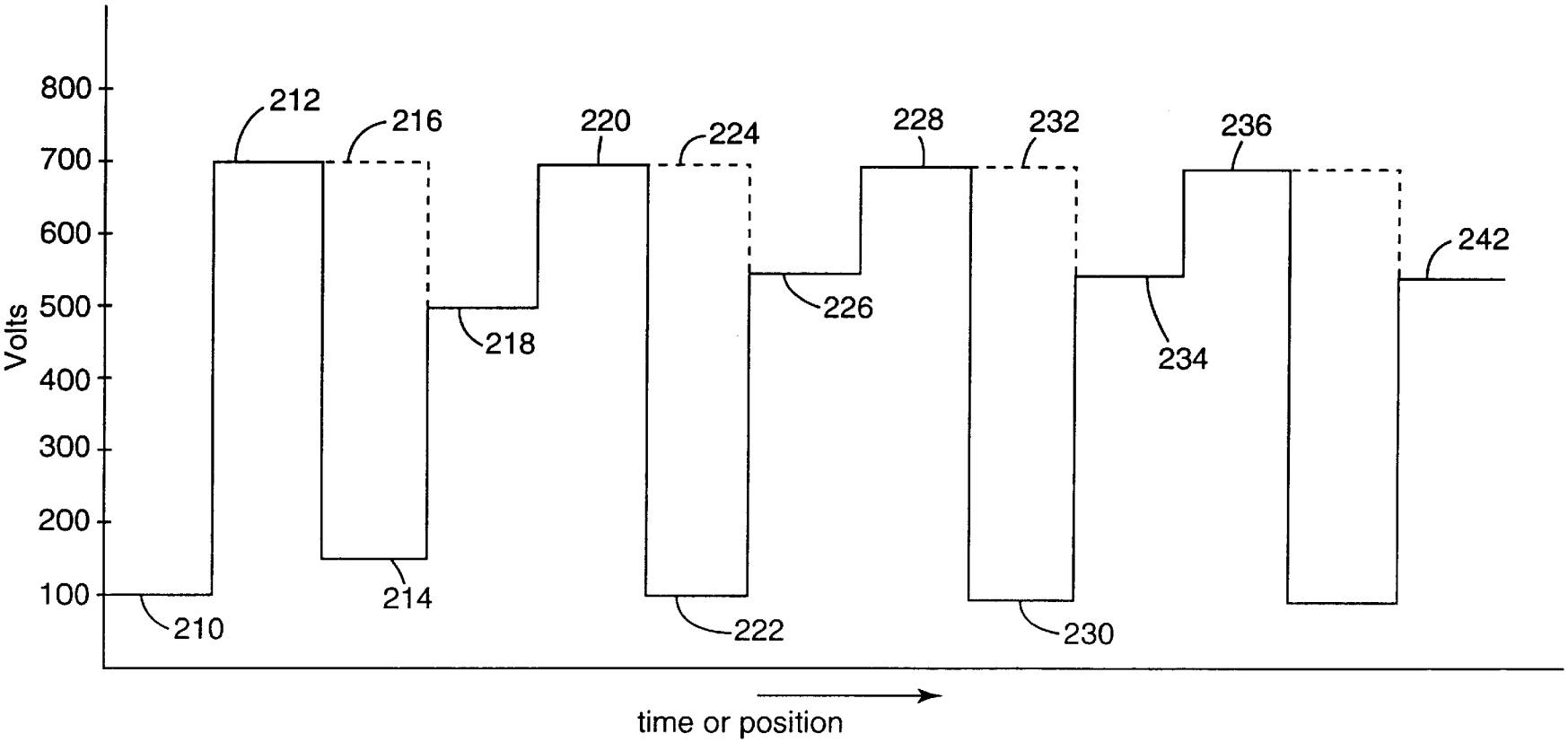
FIG. 6 is a graph illustrating the charge level on the surface of the photoreceptor in a preferred embodiment of the present invention.

Although not required, a "topping corona" (not illustrated) may be applied to photoreceptor 10 following the first three development stations 52, 60 and 68. While photoreceptor 10 recharges following development with liquid inks 54, 62 and 70, it typically does not recharge completely to the previously charged voltage. Thus, a conventional corona charging device may be employed following development stations 52, 60 and 68 to bring the voltage on photoreceptor 10 back to a preferred charging level. This is illustrated in FIG. 6 which graphically depicts the voltage on the surface of photoreceptor 10 as the process and apparatus of the present invention proceeds. Following erasure by erase lamp 14, the surface of photoreceptor 10 is at a relatively low voltage level 210, typically around 100 volts. Following charging by corona charging device 18, the surface of photoreceptor 10 is charged to a relatively high value 212 suitable to development of a liquid ink, typically around 700 volts. Following image-wise exposure to radiation by laser scanning device 50 corresponding to a first color plane (preferably yellow), the areas of the surface of photoreceptor 10 are discharged to a discharged level 214 of around 150 volts. Non-exposed areas of the surface of photoreceptor 10 remain at a highly charged level 216 of around 700 volts. Following development by developer station 52, the surface of photoreceptor 10 is substantially uniformly charged to an intermediate level 218 of around 500 volts. Discharged areas of photoreceptor 10 are developed "up" to 500 volts and non-discharged areas of photoreceptor 10 are developed "down" to 500volts. Since this developed voltage will tend to decay over time, a topping corona is preferably used to bring the surface of photoreceptor 10 back up to the high level 220 of around 700 volts. Since photoreceptor 10 has not been discharged by an erase lamp and hence remains partially charged at around 500 volts, a much smaller corona charging device than corona charging device 18 may be used for the topping corona.

Following image-wise exposure to radiation by laser scanning device 58 for second color plane (preferably magenta) of the image, the areas of the surface of photoreceptor 10 are again discharged to a discharged level 222 of around 150 volts. Non-exposed areas of the surface of photoreceptor 10 remain at a highly charged level 224 of around 700 volts. Following development by developer station 60, the surface of photoreceptor 10 is substantially uniformly charged to an intermediate level 226 of around 550 volts. Discharged areas of photoreceptor 10 are developed "up" to 550 volts and non-discharged areas of photoreceptor 10 are developed "down" to 550 volts. Again, a topping corona is preferably used to bring the surface of photoreceptor 10 back up to the high level 228 of around 700 volts.

Following image-wise exposure to radiation by laser scanning device 66 for third color plane (preferably cyan) of the image, the areas of the surface of photoreceptor 10 are again discharged to a discharged level 230 of around 150 volts. Non-exposed areas of the surface of photoreceptor 10 remain at a highly charged level 232 of around 700 volts. Following development by developer station 66, the surface of photoreceptor 10 is substantially uniformly charged to an intermediate level 234 of around 550 volts. Again, a topping corona is preferably used to bring the surface of photoreceptor 10 back up to the high level 236 of around 700 volts.

Following image-wise exposure to radiation by laser scanning device 74 for fourth color plane (preferably black)

of the image, the areas of the surface of photoreceptor 10 are again discharged to a discharged level 238 of around 150 volts. Non-exposed areas of the surface of photoreceptor 10 remain at a highly charged level 240 of around 700 volts. Following development by developer station 66, the surface of photoreceptor 10 is substantially uniformly charged to an intermediate level 242 of around 550 volts. Since this is the last color plane of the image and no further liquid ink is to be applied to the image and photoreceptor 10 will be erased before the photoreceptor is again exposed to image-wise distributed radiation, a topping corona is not preferred at this point.

At this point, all four color planes are stacked in registry on photoreceptor 10. Subsequent drying and transferring steps and mechanisms as described below are utilized to dry and then transfer the assembled full four color image to the receptive medium, e.g., paper or transparency film.

Following development of the final color plane of the image on the surface of photoreceptor 10, the assembled image is further dried in drying mechanism 34, if needed, and then transferred in a single step to an transfer roller 38 for subsequent transfer to receptor medium 36.

The "solid" color pigments of liquid inks 52, 60, 68 and 76 form a cohesive film on the surface of photoreceptor 10 before or during transfer to transfer roller 38. The image consisting of a cohesive film comprised of four layers of such "solid" color pigments of liquid inks 52, 60, 68 and 76 can be formed into a substantially dry film by using, for example, a drying roller 90. Preferably, drying roller 90 is a silicone coated roller that absorbs any remaining liquid. Drying roller 90 further dries, or "conditions" for subsequent transfer, by a drying station described in copending U.S. patent application filed on even date herewith, in the names of Schilli et al, entitled Drying Method and Apparatus for Electrophotography Using Liquid Toners, identified by File No. 52063USA1A, which is hereby incorporated by reference. Although not preferred, drying mechanism 34 may be constructed of a conventional hot air blower or other conventional means.

Following proper drying, the liquid ink image on the surface of photoreceptor 10 is brought into pressure contact with transfer roller 38 constructed of an elastomer heated to temperature T1. Temperature T1 can be in the range of 25–130 degrees Celsius and, preferably is about 80 degrees Celsius. At temperature T1, the elastomer of transfer roller 38 is tacky. Although roller is preferred for transfer roller 38, a belt is also envisioned. The liquid ink image adheres to the elastomer of transfer roller 38 when photoreceptor 10 and the elastomer surface of transfer roller 38 are separated. The surface of photoreceptor 10 releases the liquid ink image. Subsequently, the liquid ink image bearing elastomer of transfer roller 38 is brought in pressure contact with receptor medium 36, e.g. paper, at temperature T2. Temperature T2 can be in the range of 70–15- degrees Celsius and, preferably is about 115 degrees Celsius. Under the applied pressure 95 pounds per square inch (32 kilograms per centimeters squared) the liquid ink image bearing elastomer of transfer roller 38, preferably a rigid metal roller, conforms to the topography of the receptor medium 36 so that every part of the liquid ink image, including small dots, can come into contact with the surface of receptor medium 36 and transfer to receptor medium 36.

The elastomer of transfer roller 38 has sufficient adhesive properties at temperature T1 to pick up the semi-dry liquid ink image from the surface of photoreceptor surface. Further, the elastomer of transfer roller 38 has sufficient release properties at temperature T2 to allow film form liquid ink image to be released to receptor medium 36. The elastomer of transfer roller 38 is able to conform to the irregularities in the surface of receptor medium 36, e.g. the irregularities of rough paper. Conformability is accomplished by using an elastomer having a Shore A Durometer hardness of about 65 or less, preferably 50. Preferably, the elastomer should be resistant to swelling and attack by the carrier medium, e.g., hydrocarbon, for liquid inks 52, 60, 68 and 76. The elastomer of transfer roller 38 has an adhesive characteristic relative to liquid inks 52, 60, 68 and 76 that is greater than the adhesive characteristic of liquid inks 52, 60, 68 and 76 and release surface of photoreceptor 10 at temperature T1, but less than the adhesive characteristic of liquid inks 52, 60, 68 and 76 and final receptor medium 36 at temperature T2. The choice of the elastomer of transfer roller 38 is dependent on the release surface of photoreceptor 10, the composition of liquid inks 52, 60, 68 and 76, and receptor medium 36. For the process described here, several fluorosilicone elastomers meet these requirements, e.g., Dow Corning 94-003 fluorosilicone dispersion coating, available from Dow Corning Corporation, Midland, Mich.

One type of ink found particularly suitable for use as liquid inks 52, 60, 68 and 76 consists of ink materials that are substantially transparent and of low absorptivity to radiation from laser scanning devices 50, 58, 66 and 74. This allows radiation from laser scanning devices 50, 58, 66 and 74 to pass through the previously deposited ink or inks and impinge on the surface of photoreceptor 10 and reduce the deposited charge. This type of ink permits subsequent imaging to be effected through previously developed ink images as when forming a second, third, or fourth color plane without consideration for the order of color deposition. It is preferable that the inks transmit at least 80% and more preferably 90% of radiation from laser scanning devices 50, 58, 66 and 74 and that the radiation is not significantly scattered by the deposited ink material of liquid inks 52, 60, 68 and 76.

One type of ink found particularly suitable for use as liquid inks 52, 60, 68 and 76 are gel organosols which exhibit excellent imaging characteristics in liquid immersion development. For example, the gel organosol liquid inks exhibit low bulk conductivity, low free phase conductivity, low charge/mass and high mobility, all desirable characteristics for producing high resolution, background free images with high optical density. In particular, the low bulk conductivity, low free phase conductivity and low charge/mass of the inks allow them to achieve high developed optical density over a wide range of solids concentrations, thus improving their extended printing performance relative to conventional inks.

These color liquid inks on development form colored films which transmit incident radiation such as, for example, near infrared radiation, consequently allowing the photoconductor layer to discharge, while non-coalescent particles scatter a portion of the incident light. Non-coalesced ink particles therefore result in the decreasing of the sensitivity of the photoconductor to subsequent exposures and consequently there is interference with the overprinted image.

These inks have low $T_g$ values which enables the inks to form films at room temperature. Normal room temperature (19–20 degrees Celsius) is sufficient to enable film forming and of course the ambient internal temperatures of the apparatus during operation which tends to be at a higher temperature (e.g., 25–40 degrees Celsius) even without specific heating elements is sufficient to cause the ink or allow the ink to form a film.

Residual image tack after transfer may be adversely affected by the presence of high tack monomers, such as ethyl acrylate, in the organosol. Therefore, the organosols are generally formulated such that the organosol core preferably has a glass transition temperature ($T_g$) less than room temperature (25 degrees Celsius) but greater than −10 degrees Celsius. A preferred organosol core composition contains about 75 weight percent ethyl acrylate and 25 weight percent methyl methacrylate, yielding a calculated core $T_g$ of =−1 degree Celsius. This permits the inks to rapidly self-fix under normal room temperature or higher development conditions and also produce tack-free fixed images which resist blocking.

The carrier liquid may be selected from a wide variety of materials which are well known in the art. The carrier liquid is typically oleophilic, chemically stable under a variety of conditions, and electrically insulating. Electrically insulating means that the carrier liquid has a low dielectric constant and a high electrical resistivity. Preferably, the carrier liquid has a dielectric constant of less than 5, and still more preferably less than 3. Examples of suitable carrier liquids are aliphatic hydrocarbons (n-pentane, hexane, heptane and the like), cycloaliphatic hydrocarbons (cyclopentane, cyclohexane and the like), aromatic hydrocarbons (benzene, toluene, xylene and the like), halogenated hydrocarbon solvents (chlorinated alkanes, fluorinated alkanes, chlorofluorocarbons and the like), silicone oils and blends of these solvents. Preferred carrier liquids include paraffinic solvent blends sold under the names Isopar G liquid, Isopar H liquid, Isopar K liquid and Isopar L liquid (manufactured by Exxon Chemical Corporation, Houston, Tex.). The preferred carrier liquid is Norpar 12 liquid, also available from Exxon Corporation.

The toner particles are comprised of colorant embedded in a thermoplastic resin. The colorant may be a dye or more preferably a pigment. The resin may be comprised of one or more polymers or copolymers which are characterized as being generally insoluble or only slightly soluble in the carrier liquid; these polymers or copolymers comprise a resin core. In addition, superior stability of the dispersed toner particles with respect to aggregation is obtained when at least one of the polymers or copolymers (denoted as the stabilizer) is an amphipathic substance containing at least one chain-like component of molecular weight at least 500 which is solvated by the carrier liquid. Under such conditions, the stabilizer extends from the resin core into the carrier liquid, acting as a steric stabilizer as discussed in Dispersion Polymerization (Ed. Barrett, Interscience., p. 9 (1975). Preferably, the stabilizer is chemically incorporated into the resin core, i.e., covalently bonded or grafted to the core, but may alternatively be physically or chemically adsorbed to the core such that it remains as an integral part of the resin core.

The composition of the resin is preferentially manipulated such that the organosol exhibits an effective glass transition temperature (Tg) of less than 25 degrees Celsius (more preferably less than 6 degrees Celsius), thus causing an ink composition of liquid inks 52, 60, 68 and 76 containing the resin as a major component to undergo rapid film formation (rapid self fixing) in printing or imaging processes carried out at temperatures greater than the core Tg (preferably at or above 25 degrees Celsius). The use of low Tg resins to promote rapid self fixing of printed or toned images is known in the art, as exemplified by Film Formation (Z. W. Wicks, Federation of Societies for Coatings Technologies, p. 8 (1986). Rapid self fixing is thought to avoid printing defects (such as smearing or trailing-edge tailing) and incomplete transfer in high speed printing. For printing on plain paper, it is preferred that the core Tg be greater than minus 10 degrees Celsius and, more preferably, be in the range from minus 5 degrees Celsius to plus 5 degrees Celsius so that the final image is not tacky and has good block resistance.

Examples of resin materials suitable for use in liquid inks 52, 60, 68 and 76 include polymers and copolymers of (meth)acrylic esters; including methyl acrylate, ethyl acrylate, butyl acrylate, ethylhexyl acrylate, 2-ethylhexylmethacrylate, lauryl acrylate, octadecyl acrylate, methyl(methacrylate), ethyl(methacrylate), lauryl methacrylate, hydroxy(ethylmethacrylate), octadecyl (methacrylate) and other polyacrylates. Other polymers may be used in conjunction with the aforementioned materials, including melamine and melamine formaldehyde resins, phenol formaldehyde resins, epoxy resins, polyester resins, styrene and styrene/acrylic copolymers, acrylic and methacrylic esters, cellulose acetate and cellulose acetatebutyrate copolymers, and poly(vinyl butyral) copolymers.

The colorants which may be used in liquid inks 52, 60, 68 and 76 include virtually any dyes, stains or pigments which may be incorporated into the polymer resin, which are compatible with the carrier liquid, and which are useful and effective in making visible the latent electrostatic image. Examples of suitable colorants include: Phthalocyanine blue (C.I. Pigment Blue 15 and 16), Quinacridone magenta (C.I. Pigment Red 122, 192, 202 and 206), Rhodamine YS (C.I. Pigment Red 81), diarylide (benzidine) yellow (C.I. Pigment Yellow 12, 13, 14, 17, 55, 83 and 155) and arylamide (Hansa) yellow (C.I. Pigment Yellow 1, 3, 10, 73, 74, 97, 105 and 111); organic dyes, and black materials such as finely divided carbon and the like.

The optimal weight ratio of resin to colorant in the toner particles is on the order of 1/1 to 20/1, most preferably between 10/1 and 3/1. The total dispersed "solid" material in the carrier liquid typically represents 0.5 to 20 weight percent, most preferably between 0.5 and 3 weight percent of the total liquid developer composition.

Liquid inks 52, 60, 68 and 76 include a soluble charge control agent, sometimes referred to as a charge director, to provide uniform charge polarity of the toner particles. The charge director may be incorporated into the toner particles, may be chemically reacted to the toner particle, may be chemically or physically adsorbed onto the toner particle (resin or pigment), and may be chelated to a functional group incorporated into the toner particle, preferably via a functional group comprising the stabilizer. The charge director acts to impart an electrical charge of selected polarity (either positive or negative) to the toner particles. Any number of charge directors described in the art may be used herein; preferred positive charge directors are the metallic soaps. See U.S. Pat. No. 3,411,936, Rotsman et al. The preferred charge directors are polyvalent metal soaps of zirconium and aluminum, preferably zirconium octoate.

The particular liquid inks 52, 60, 68 and 76 preferred are described with more particularity in copending U.S. patent application filed on even date herewith in the names of Baker et al, entitled "Printing Ink Containing Gelled Organosol", identified by File No. 52069USA8A, which is hereby incorporated by reference.

While the present invention has been described with respect to it preferred embodiments, it is to be recognized and understood that changes, modifications and alterations in the form and in the details may be made without departing from the scope of the following claims.

What is claimed is:

1. A method of producing a multi-colored image on a medium from image data in a liquid electrophotographic system, comprising the steps of:

movably positioning a photoreceptor in order that a given portion of said photoreceptor sequentially advances past a plurality of locations so that the following steps are performed in a single pass;

erasing any previously accumulated charge from said photoreceptor;

charging said photoreceptor to a predetermined charge level;

first image-wise exposing said photoreceptor with radiation modulated in accordance with said image data for one of a plurality of colors in order to partially discharge said photoreceptor to a first discharged level to produce an image-wise distribution of charges on said photoreceptor corresponding to said image data for said one of said plurality of colors;

applying a first color liquid toner containing charged particles of said first color and transparent counter ions, using an electrode electrically biased to a voltage of between said predetermined charge level and said first discharged level, to said photoreceptor as a function of said image-wise distribution of charges on said photoreceptor to form a first color image, said photoreceptor recharging as a result of this step to a substantially uniform second predetermined charge level, said second predetermined charge level being lower than said first predetermined charge level but being sufficiently high to subsequently repel liquid toner in areas not subsequently further discharged;

second image-wise exposing said photoreceptor with radiation modulated in accordance with said image data for another of said plurality of colors in order to partially discharge said photoreceptor to produce an image-wise distribution of charges on said photoreceptor corresponding to said image data for said another of said plurality of colors in registration with said first color image;

said second image-wise exposing of said photoreceptor step occurring without erasing said photoreceptor subsequent to said first image-wise exposing of said photoreceptor step;

applying a second color liquid toner to said image-wise distribution of charges on said photoreceptor to form a second color image in registration with said first color image;

transferring said first color image and said second color image together from said photoreceptor to said medium to form said multi-colored image.

2. A method as in claim 1 wherein said movably positioning of said photoreceptor is uniform.

3. A method as in claim 1 wherein said charging step uniformly charges said photoreceptor to said first predetermined charge level.

4. A method as in claim 1 which comprises the additional step of drying said first color liquid toner following said applying said first liquid color toner step.

5. A method as in claim 4 which comprises the additional step of drying said second color liquid toner following said applying said second liquid color toner step.

6. A method of producing a multi-colored image on a medium from image data in a liquid electrophotographic system, comprising the steps of:

uniformly rotating a photoreceptor so that the following steps are performed in order;

erasing any previously accumulated charge from said photoreceptor;

uniformly charging said photoreceptor to a first predetermined charge level;

first image-wise exposing said photoreceptor with radiation modulated in accordance with said image data for one of a plurality of colors in order to partially discharge said photoreceptor to produce an image-wise distribution of charges on said photoreceptor corresponding to said image data for said one of said plurality of colors;

applying a first color liquid toner containing charged particles of said first color and transparent counter ions to said photoreceptor as a function of said image-wise distribution of charges on said photoreceptor to develop said photoreceptor and form a first color image, said photoreceptor recharging as a result of this step to a substantially uniform second predetermined charge level, said second predetermined charge level being lower than said first predetermined charge level but being sufficiently high to subsequently repel liquid toner in areas not subsequently further discharged;

second image-wise exposing, without erasing previously accumulated charge on said photoreceptor subsequent to said first image-wise exposing step, said photoreceptor with radiation modulated in accordance with said image data for another of said plurality of colors in order to partially discharge said photoreceptor to produce an image-wise distribution of charges on a surface of said photoreceptor corresponding to said image data for said another of said plurality of colors in registration with said first color image;

applying a second color liquid toner to said image-wise distribution of charges on said photoreceptor to form a second color image in registration with said first color image;

transferring said first color image and said second color image together from said photoreceptor to said medium to form said multi-colored image.

7. A method as in claim 6 wherein said movably positioning of said photoreceptor is uniform.

8. A method as in claim 6 wherein said charging step uniformly charges said photoreceptor to said first predetermined charge level.

9. A method as in claim 6 which comprises the additional step of drying said first color liquid toner following said applying said first liquid color toner step.

10. A method as in claim 9 which comprises the additional step of drying said second color liquid toner following said applying said second liquid color toner step.

11. A method of producing a multi-colored image on a medium from image data in a liquid electrophotographic system, comprising the steps of:

rotating a photoreceptor so that the following steps are performed in a single pass;

erasing any previously accumulated charge from said photoreceptor;

charging said photoreceptor to a first predetermined charge level;

first image-wise exposing said photoreceptor with radiation modulated in accordance with said image data for one of a plurality of colors in order to partially discharge said photoreceptor to produce an image-wise distribution of charges on said photoreceptor corresponding to said image data for said one of said plurality of colors;

applying a first color liquid toner containing charged particles of said first color and transparent counter ions to said photoreceptor as a function of said image-wise distribution of charges on said photoreceptor to develop said photoreceptor and form a first color image, said photoreceptor recharging as a result of this step to a substantially uniform second charge level, said second charge level being lower than said first predetermined charge level but being sufficiently high to subsequently repel liquid toner to said photoreceptor in areas not subsequently further discharged;

second image-wise exposing said photoreceptor with radiation modulated in accordance with said image data for a second of said plurality of colors in order to partially discharge said photoreceptor to produce an image-wise distribution of charges on a surface of said photoreceptor corresponding to said image data for said second of said plurality of colors in registration with said first color image;

applying a second color liquid toner containing charged particles of said second color and transparent counter ions to said photoreceptor as a function of said image-wise distribution of charges on said photoreceptor in registration with said first color image, said photoreceptor recharging as a result of this step to a substantially uniform third charge level, said third charge level being lower than said second charge level but being sufficiently high to subsequently repel liquid toner in areas of said photoreceptor not subsequently further discharged;

third image-wise exposing said photoreceptor with radiation modulated in accordance with said image data for a third of said plurality of colors in order to partially discharge said photoreceptor to produce an image-wise distribution of charges on a surface of said photoreceptor corresponding to said image data for said third of said plurality of colors in registration with said first color image and second color image;

applying a third color liquid toner containing charged particles of said third color and transparent counter ions to said photoreceptor as a function of said image-wise distribution of charges on said photoreceptor to form a third color image in registration with said first color image and said second color image, said photoreceptor recharging as a result of this step to a substantially uniform fourth charge level, said fourth charge level being lower than said third charge level but being sufficiently high to subsequently repel liquid toner in areas of said photoreceptor not subsequently further discharged;

fourth image-wise exposing said photoreceptor with radiation modulated in accordance with said image data for a fourth of said plurality of colors in order to partially discharge said photoreceptor to produce an image-wise distribution of charges on a surface of said photoreceptor corresponding to said image data for said fourth of said plurality of colors in registration with said first color image, second color image and said third color image;

applying a fourth color liquid toner to said image-wise distribution of charges on said photoreceptor to form a fourth color image in registration with said first color image, said second color image and said third color image;

transferring said first color image, said second color image, said third color image and said fourth color image together from said photoreceptor to said medium to form said multi-colored image.

12. A method as in claim 11 wherein said movably positioning of said photoreceptor is uniform.

13. A method as in claim 11 wherein said charging step uniformly charges said photoreceptor to said first predetermined charge level.

14. A method as in claim 11 which comprises the additional steps of:

drying said first color liquid toner following said applying said first liquid color toner step;

drying said second color liquid toner following said applying said second liquid color toner step; and drying said third color liquid toner following said applying said third liquid color toner step.

15. A method as in claim 14 which comprises the additional step of drying said fourth color liquid toner following said applying said fourth liquid color toner step.

16. A method as in claim 11 wherein said first color liquid toner is a liquid toner principally containing the color of yellow, wherein said second color liquid toner is a liquid toner principally containing the color of magenta, wherein said third color liquid toner is a liquid toner principally containing the color of cyan and wherein said fourth color liquid toner is a liquid toner principally containing the color of black.

17. An apparatus for producing a multi-colored image on a medium from image data in a liquid electrophotographic system, comprising:

positioning means for movably positioning a photoreceptor in order that a given portion of said photoreceptor sequentially advances past a plurality of locations in a single pass;

erasing means for erasing any previously accumulated charge from said photoreceptor;

charging means for charging said photoreceptor to a predetermined charge level;

first image-wise exposing means for exposing said photoreceptor with radiation modulated in accordance with said image data for one of a plurality of colors in order to partially discharge said photoreceptor to a first discharged level to produce an image-wise distribution of charges on said photoreceptor corresponding to said image data for said one of said plurality of colors;

first application means for applying a first color liquid toner containing charged particles of said first color and transparent counter ions, using an electrode electrically biased to a voltage of between said predetermined charge level and said first discharged level, to said photoreceptor as a function of said image-wise distribution of charges on said photoreceptor to form a first color image, said photoreceptor recharging as a result of this step to a substantially uniform second predetermined charge level said second predetermined charge level being lower than said first predetermined charge level but being sufficiently high to subsequently repel liquid toner in areas not subsequently further discharged;

second image-wise exposing means for exposing said photoreceptor with radiation modulated in accordance with said image data for another of said plurality of colors in order to partially discharge said photoreceptor to produce an image-wise distribution of charges on said photoreceptor corresponding to said image data for said another of said plurality of colors in registration with said first color image;

said second image-wise exposing means occurring without erasing said photoreceptor subsequent to said first image-wise exposing of said photoreceptor;

second application means for applying a second color liquid toner to said image-wise distribution of charges on said photoreceptor to form a second color image in registration with said first color image;

transferring means for transferring said first color image and said second color image together from said photoreceptor to said medium to form said multi-colored image.

18. An apparatus as in claim 17 wherein said positioning means movably positions said photoreceptor uniformly.

19. An apparatus as in claim 17 wherein said charging means uniformly charges said photoreceptor to said first predetermined charge level.

20. An apparatus as in claim 17 which further comprises first drying means for drying said first color liquid toner.

21. An apparatus as in claim 20 which further comprises second drying means for drying said second color liquid toner.

22. An apparatus for producing a multi-colored image on a medium from image data in a liquid electrophotographic system, comprising:

rotating means for moving a photoreceptor sequentially past a number of locations in order;

erasing means for erasing any previously accumulated charge from said photoreceptor;

charging means for charging said photoreceptor to a first predetermined charge level;

first image-wise exposing means for exposing said photoreceptor with radiation modulated in accordance with said image data for one of a plurality of colors in order to partially discharge said photoreceptor to produce an image-wise distribution of charges on said photoreceptor corresponding to said image data for said one of said plurality of colors;

first application means for applying a first color liquid toner containing charged particles of said first color and transparent counter ions to said photoreceptor as a function of said image-wise distribution of charges on said photoreceptor to develop said photoreceptor and form a first color image, said photoreceptor recharging to a substantially uniform second predetermined charge level, said second predetermined charge level being lower than said first predetermined charge level but being sufficiently high to subsequently repel liquid toner in areas not subsequently further discharged;

second image-wise exposing means for exposing said photoreceptor, without erasing previously accumulated charge on said photoreceptor subsequent to said first image-wise exposing, with radiation modulated in accordance with said image data for another of said plurality of colors in order to partially discharge said photoreceptor to produce an image-wise distribution of charges on a surface of said photoreceptor corresponding to said image data for said another of said plurality of colors in registration with said first color image;

second application means for applying a second color liquid toner to said image-wise distribution of charges on said photoreceptor to form a second color image in registration with said first color image;

transferring means for transferring said first color image and said second color image together from said photoreceptor to said medium to form said multi-colored image.

23. An apparatus as in claim 22 wherein said rotating means movably positions said photoreceptor uniformly.

24. An apparatus as in claim 22 wherein said charging means uniformly charges said photoreceptor to said first predetermined charge level.

25. An apparatus as in claim 22 which further comprises first drying means for drying said first color liquid toner.

26. An apparatus as in claim 25 which further comprises second drying means for drying said second color liquid toner.

27. An apparatus for producing a multi-colored image on a medium from image data in a liquid electrophotographic system, comprising:

rotating means for rotating a photoreceptor past a plurality of locations in a single pass;

erasing means for erasing any previously accumulated charge from said photoreceptor;

charging means for charging said photoreceptor to a first predetermined charge level;

first image-wise exposing means for exposing said photoreceptor with radiation modulated in accordance with said image data for one of a plurality of colors in order to partially discharge said photoreceptor to produce an image-wise distribution of charges on said photoreceptor corresponding to said image data for said one of said plurality of colors;

first application means for applying a first color liquid toner containing charged particles of said first color and transparent counter ions to said photoreceptor as a function of said image-wise distribution of charges on said photoreceptor to develop said photoreceptor and form a first color image, said photoreceptor recharging to a substantially uniform second charge level, said second charge level being lower than said first predetermined charge level but being sufficiently high to subsequently repel liquid toner to said photoreceptor in areas not subsequently further discharged;

second image-wise exposing means for exposing said photoreceptor with radiation modulated in accordance with said image data for a second of said plurality of colors in order to partially discharge said photoreceptor to produce an image-wise distribution of charges on a surface of said photoreceptor corresponding to said image data for said second of said plurality of colors in registration with said first color image;

second application means for applying a second color liquid toner containing charged particles of said second color and transparent counter ions to said photoreceptor as a function of said image-wise distribution of charges on said photoreceptor in registration with said first color image, said photoreceptor recharging to a substantially uniform third charge level, said third charge level being lower than said second charge level but being sufficiently high to subsequently repel liquid toner in areas of said photoreceptor not subsequently further discharged;

third image-wise exposing means for exposing said photoreceptor with radiation modulated in accordance with said image data for a third of said plurality of colors in order to partially discharge said photoreceptor to produce an image-wise distribution of charges on a surface of said photoreceptor corresponding to said image data for said third of said plurality of colors in registration with said first color image and second color image;

third application means for applying a third color liquid toner containing charged particles of said third color and transparent counter ions to said photoreceptor as a function of said image-wise distribution of charges on said photoreceptor to form a third color image in registration with said first color image and said second color image, said photoreceptor recharging to a substantially uniform fourth charge level, said fourth charge level being lower than said third charge level but being sufficiently high to subsequently repel liquid toner in areas of said photoreceptor not subsequently further discharged;

fourth image-wise exposing means for exposing said photoreceptor with radiation modulated in accordance with said image data for a fourth of said plurality of colors in order to partially discharge said photoreceptor to produce an image-wise distribution of charges on a surface of said photoreceptor corresponding to said image data for said fourth of said plurality of colors in registration with said first color image, second color image and said third color image;

fourth application means for applying a fourth color liquid toner to said image-wise distribution of charges on said photoreceptor to form a fourth color image in registration with said first color image, said second color image and said third color image;

transferring means for transferring said first color image, said second color image, said third color image and said fourth color image together from said photoreceptor to said medium to form said multi-colored image.

28. An apparatus as in claim 27 wherein said rotating means movably positions said photoreceptor uniformly.

29. An apparatus as in claim 27 wherein said charging means uniformly charges said photoreceptor to said first predetermined charge level.

30. An apparatus as in claim 28 which further comprises:

first drying means for drying said first color liquid toner;

second drying means for drying said second color liquid toner; and third drying means for drying said third color liquid toner.

31. An apparatus as in claim 30 which further comprises fourth drying means for drying said fourth color liquid toner.

32. An apparatus as in claim 27 wherein said first color liquid toner is a liquid toner principally containing the color of yellow, wherein said second color liquid toner is a liquid toner principally containing the color of magenta, wherein said third color liquid toner is a liquid toner principally containing the color of cyan and wherein said fourth color liquid toner is a liquid toner principally containing the color of black.

33. A method of producing a multi-colored image on a medium from image data in a liquid electrophotographic system, comprising the steps of:

charging said photoreceptor to a first predetermined charge level;

first image-wise exposing said photoreceptor with radiation modulated in accordance with said image data for one of a plurality of colors in order to partially discharge said photoreceptor to produce an image-wise distribution of charges on said photoreceptor corresponding to said image data for said one of said plurality of colors;

applying a first color liquid toner to said image-wise distribution of charges on said photoreceptor to develop said photoreceptor and form a first color image, said first color liquid toner containing charged particles of said first color and transparent counter ions, said photoreceptor recharging as a result of this step to a second predetermined charge level, said second predetermined charge level being lower than said first predetermined charge level but being sufficiently high to subsequently repel liquid toner in areas not subsequently further discharged;

second image-wise exposing said photoreceptor with radiation modulated in accordance with said image data for another of said plurality of colors in order to partially discharge said photoreceptor to produce an image-wise distribution of charges on a surface of said photoreceptor corresponding to said image data for said another of said plurality of colors in registration with said first color image;

applying a second color liquid toner to said image-wise distribution of charges on said photoreceptor to form a second color image in registration with said first color image;

transferring said first color image and said second color image together from said photoreceptor to said medium to form said multi-colored image.

34. A method as in claim 33 which first includes the step of erasing previously accumulated charge from said photoreceptor.

35. A method as in claim 33 wherein said charging step uniformly charges said photoreceptor to said first predetermined charge level.

36. A method as in claim 33 which comprises the additional step of drying said first color liquid toner following said applying said first liquid color toner step.

37. A method as in claim 36 which comprises the additional step of drying said second color liquid toner following said applying said second liquid color toner step.

38. A method of producing a multi-colored image on a medium from image data in a liquid electrophotographic system, comprising the steps of:

charging said photoreceptor to a first predetermined charge level;

first image-wise exposing said photoreceptor with radiation modulated in accordance with said image data for one of a plurality of colors in order to partially discharge said photoreceptor to produce an image-wise distribution of charges on said photoreceptor corresponding to said image data for said one of said plurality of colors;

applying a first color liquid toner to said image-wise distribution of charges on said photoreceptor to develop said photoreceptor and form a first color image, said first color liquid toner containing charged particles of said first color and transparent counter ions, said photoreceptor recharging as a result of this step to a second predetermined charge level, said second predetermined charge level being lower than said first predetermined charge level but being sufficiently high to subsequently repel liquid toner in areas not subsequently further discharged;

second image-wise exposing said photoreceptor with radiation modulated in accordance with said image data for a second of said plurality of colors in order to partially discharge said photoreceptor to produce an image-wise distribution of charges on a surface of said photoreceptor corresponding to said image data for said second of said plurality of colors in registration with said first color image;

applying a second color liquid toner to said image-wise distribution of charges on said photoreceptor to form a second color image in registration with said first color image;

third image-wise exposing said photoreceptor with radiation modulated in accordance with said image data for a third of said plurality of colors in order to partially discharge said photoreceptor to produce an image-wise distribution of charges on a surface of said photoreceptor corresponding to said image data for said third of said plurality of colors in registration with said first color image and said second color image;

applying a third color liquid toner to said image-wise distribution of charges on said photoreceptor to form a third color image in registration with said first color image and said second color image;

fourth image-wise exposing said photoreceptor with radiation modulated in accordance with said image data for a fourth of said plurality of colors in order to partially discharge said photoreceptor to produce an image-wise distribution of charges on a surface of said photoreceptor corresponding to said image data for said fourth of said plurality of colors in registration with said first color image, said second color image and said third color image;

applying a fourth color liquid toner to said image-wise distribution of charges on said photoreceptor to form a fourth color image in registration with said first color image, said second color image and said third color image;

transferring said first color image, said second color image, said third color image and said fourth color image together from said photoreceptor to said medium to form said multi-colored image.

39. A method as in claim 38 which first includes the step of erasing previously accumulated charge from said photoreceptor.

40. A method as in claim 38 wherein said charging step uniformly charges said photoreceptor to said first predetermined charge level.

41. A method as in claim 38 which comprises the additional steps of:

drying said first color liquid toner following said applying said first liquid color toner step;

drying said second color liquid toner following said applying said second liquid color toner step; and drying said third color liquid toner following said applying said third liquid color toner step.

42. A method as in claim 41 which comprises the additional step of drying said fourth color liquid toner following said applying said fourth liquid color toner step.

43. A method as in claim 38 wherein said first color liquid toner is a liquid toner principally containing the color of yellow, wherein said second color liquid toner is a liquid toner principally containing the color of magenta, wherein said third color liquid toner is a liquid toner principally containing the color of cyan and wherein said fourth color liquid toner is a liquid toner principally containing the color of black.

44. An apparatus for producing a multi-colored image on a medium from image data in a liquid electrophotographic system, comprising:

charging means for charging said photoreceptor to a first predetermined charge level;

first image-wise exposing means for exposing said photoreceptor with radiation modulated in accordance with said image data for one of a plurality of colors in order to partially discharge said photoreceptor to produce an image-wise distribution of charges on said photoreceptor corresponding to said image data for said one of said plurality of colors;

first application means for applying a first color liquid toner containing charged particles of said first color and transparent counter ions to said photoreceptor as a function of said image-wise distribution of charges on said photoreceptor to develop said photoreceptor and form a first color image, said photoreceptor recharging to a substantially uniform second predetermined charge level, said second predetermined charge level being lower than said first predetermined charge level but being sufficiently high to subsequently repel liquid toner in areas not subsequently further discharged;

second image-wise exposing means for exposing said with radiation modulated in accordance with said image data for another of said plurality of colors in order to partially discharge said photoreceptor to produce an image-wise distribution of charges on a surface of said photoreceptor corresponding to said image data for said another of said plurality of colors in registration with said first color image;

second application means for applying a second color liquid toner to said image-wise distribution of charges on said photoreceptor to form a second color image in registration with said first color image; and transferring means for transferring said first color image and said second color image together from said photoreceptor to said medium to form said multi-colored image.

45. An apparatus as in claim 44 which further comprising erasing means for erasing previously accumulated charge from said photoreceptor prior to said charging means.

46. An apparatus as in claim 44 wherein charging means uniformly charges said photoreceptor to said first predetermined charge level.

47. An apparatus as in claim 44 which further comprises first drying means for drying said first color liquid toner.

48. An apparatus as in claim 47 which further comprises second drying means for drying said second color liquid toner.

49. An apparatus for producing a multi-colored image on a medium from image data in a liquid electrophotographic system, comprising:

charging means for charging said photoreceptor to a first predetermined charge level;

first image-wise exposing means for exposing said photoreceptor with radiation modulated in accordance with said image data for one of a plurality of colors in order to partially discharge said photoreceptor to produce an image-wise distribution of charges on said photoreceptor corresponding to said image data for said one of said plurality of colors;

first application means for applying a first color liquid toner containing charged particles of said first color and transparent counter ions to said photoreceptor as a function of said image-wise distribution of charges on said photoreceptor to develop said photoreceptor and form a first color image, said photoreceptor recharging to a substantially uniform second predetermined charge level, said second predetermined charge level being lower than said first predetermined charge level but being sufficiently high to subsequently repel liquid toner in areas not subsequently further discharged;

second image-wise exposing means for exposing said with radiation modulated in accordance with said image data for a second of said plurality of colors in order to partially discharge said photoreceptor to produce an image-wise distribution of charges on a surface of said photoreceptor corresponding to said image data for said second of said plurality of colors in registration with said first color image;

second application means for applying a second color liquid toner containing charged particles of said second color and transparent counter ions to said image-wise distribution of charges on said photoreceptor to develop said photoreceptor and form a second color image, said photoreceptor recharging to a third predetermined charge level, said third predetermined charge level being lower than said second predetermined charge level but being sufficiently high to subsequently repel liquid toner in areas not subsequently further discharged;

third image-wise exposing means for exposing said with radiation modulated in accordance with said image data for a third of said plurality of colors in order to partially discharge said photoreceptor to produce an image-wise distribution of charges on a surface of said photoreceptor corresponding to said image data for said third of said plurality of colors in registration with said first color image and said second color image;

third application means for applying a third color liquid toner containing charged particles of said third color and transparent counter ions to said image-wise distribution of charges on said photoreceptor to develop said photoreceptor and form a third color image, said photoreceptor recharging to a fourth predetermined charge level, said fourth predetermined charge level being lower than said third predetermined charge level but being sufficiently high to subsequently repel liquid toner in areas not subsequently further discharged;

fourth image-wise exposing means for exposing said with radiation modulated in accordance with said image data for a fourth of said plurality of colors in order to partially discharge said photoreceptor to produce an image-wise distribution of charges on a surface of said photoreceptor corresponding to said image data for said fourth of said plurality of colors in registration with said first color image, said second color image and said third color image;

fourth application means for applying a fourth color liquid toner to said image-wise distribution of charges on said photoreceptor to form a fourth color image in registration with said first color image, said second color image and said third color image; and transferring means for transferring said first color image, said second color image, said third color image and said fourth color image together from said photoreceptor to said medium to form said multi-colored image.

50. An apparatus as in claim 49 which further comprising erasing means for erasing previously accumulated charge from said photoreceptor prior to said charging means.

51. An apparatus as in claim 49 wherein charging means uniformly charges said photoreceptor to said first predetermined charge level.

52. An apparatus as in claim 49 which further comprises:

first drying means for drying said first color liquid toner;

second drying means for drying said second color liquid toner; and third drying means for drying said third color liquid toner.

53. An apparatus as in claim 52 which further comprises fourth drying means for drying said fourth color liquid toner.

54. An apparatus as in claim 49 wherein said first color liquid toner is a liquid toner principally containing the color of yellow, wherein said second color liquid toner is a liquid toner principally containing the color of magenta, wherein said third color liquid toner is a liquid toner principally containing the color of cyan and wherein said fourth color liquid toner is a liquid toner principally containing the color of black.

* * * * *